US007334859B2

(12) United States Patent
Kojima

(10) Patent No.: US 7,334,859 B2
(45) Date of Patent: Feb. 26, 2008

(54) INKJET RECORDING APPARATUS AND DISCHARGE DEFECT DETERMINATION METHOD

(75) Inventor: Toshiya Kojima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 408 days.

(21) Appl. No.: 10/932,021

(22) Filed: Sep. 2, 2004

(65) Prior Publication Data

US 2005/0046658 A1 Mar. 3, 2005

(30) Foreign Application Priority Data

Sep. 3, 2003 (JP) ..... 2003-311485

(51) Int. Cl.
*B41J 29/393* (2006.01)

(52) U.S. Cl. ..... 347/19; 347/42

(58) Field of Classification Search ..... 347/19, 347/42, 13, 15

See application file for complete search history.

(56) References Cited

U.S. PATENT DOCUMENTS 5,581,284 A * 12/1996 Hermanson ..... 347/43
6,036,300 A 3/2000 Suzuki et al.
6,471,323 B2 * 10/2002 Shibata et al. ..... 347/15
6,491,373 B1 * 12/2002 Fujita et al. ..... 347/41
6,547,361 B1 4/2003 Suzuki et al.
2002/0008731 A1 * 1/2002 Matsumoto et al. ..... 347/42

FOREIGN PATENT DOCUMENTS

JP 05-301427 A 11/1993
JP 6-115098 A 4/1994
JP 06-143548 A 5/1994
JP 6-328724 A 11/1994
JP 9-39223 A 2/1997
JP 2001-341294 A 12/2001

* cited by examiner

*Primary Examiner*—Lamson Nguyen
(74) *Attorney, Agent, or Firm*—Birch, Stewart, Kolasch & Birch, LLP

(57) ABSTRACT

The inkjet recording apparatus comprises: a plurality of full-line recording heads provided for a plurality of ink colors, each of the plurality of full-line recording heads having one or more rows of nozzles in which a plurality of nozzles for discharging ink are arrayed across an entire width of a printing medium in a direction substantially orthogonal to a conveyance direction of the printing medium; and a plurality of image-reading devices provided for the plurality of ink colors, the plurality of image-reading devices reading an image formed on the printing medium with ink ejected from the plurality of recording heads provided for the colors, the plurality of image-reading devices being arranged on a downstream side in the conveyance direction of the printing medium with respect to the recording heads of the respective corresponding colors.

8 Claims, 14 Drawing Sheets

INKJET RECORDING APPARATUS AND DISCHARGE DEFECT DETERMINATION METHOD

This Non-provisional application claims priority under 35 U.S.C. §119(*a*) on Patent Application No(s). 2003-311485 filed in Japan on Sep. 3, 2003, the entire contents of which are hereby incorporated by reference.

BACKGROUND OF THE INVENTION

1. Field of the Invention

The present invention relates to an inkjet recording apparatus and a discharge defect determination method, and more particularly to technology for determining discharge defects in an inkjet recording apparatus that uses a line head in which a plurality of recording elements is arrayed in one direction.

2. Description of the Related Art

In recent years, inkjet recording apparatuses (inkjet printers) serving as recording apparatuses that print/record images or the like taken by digital still camera have become widely distributed. Inkjet recording apparatuses are advantageous in that they are relatively inexpensive, are simple to handle, and allow good quality images to be obtained. Inkjet recording apparatuses have a plurality of recording elements in the head, the recording head is moved to scan the recording medium while ink droplets are discharged from the recording elements to the recording medium, the recording medium is conveyed by a single line when one line of image has been recorded on recording paper, and an image is formed on the recording paper by repeating these steps.

There are inkjet printers that use a short serial head and record images while causing the head to scan in the width direction of the recording medium, or those that use a line head in which recording elements are arrayed across the entire range of one side of the recording medium. In printers in which a line head is used, images can be recorded on the entire surface of the recording medium by scanning the recording medium in the direction orthogonal to the array direction of the recording elements. In printers in which a line head is used, a carriage or another conveyance system for moving the short head back and forth is unnecessary, and complex scanning control for the carriage movement and recording medium is not required. Also, the recording medium alone moves, so recording speed can be increased in comparison with printers in which a serial head is used.

On the other hand, in an inkjet recording apparatus provided with a full-line head, stripe nonuniformity is generated in the sub-scanning direction, which is the conveyance direction of the printing medium, and print quality may be degraded. In an inkjet recording apparatus provided with a full-line head that can print one line at a time in the main scanning direction, which is orthogonal to the sub-scanning direction, and that prints to the entire print area with one scan in the sub-scanning direction, when there are nozzles from which ink droplets are not discharged and nozzles in which the discharge direction and amount of ink droplets fluctuates, a phenomenon arises whereby dots that should be formed by droplet ejection from the nozzles are not formed or the droplet deposition position is displaced. A variety of proposals have been made to determine such defective nozzles and to inhibit their effect on the print result.

In the image recording method, apparatus, recorded matter thereof, and manufactured products thereof disclosed in Japanese Patent Application Publication No. 5-301427, the shuttle head is provided with a read device that scans together with the recording head and reads images recorded on a printing medium, and with a determination device for determining defective recording positions from the recorded image read by the read device. The head is configured so as to use the compensating recording device to compensate in later scans for defective recording positions determined by the determination device.

The inkjet recording apparatus disclosed in Japanese Patent Application Publication No. 6-143548 has a read device disposed rearward with respect to the recording scanning direction of the recording head. The apparatus is configured so as to determine the discharge state of the ink with a determination device from the image read by the read device, and to perform predetermined restorative operation to the recording elements determined to be defective by the determination device.

Nevertheless, as the nozzles are made more highly dense, it is difficult to accurately determine the discharge, non-discharge, discharge direction, and discharge amount of ink droplets for every single nozzle. Assuming that an error in determining defective nozzles has occurred, restorative operation does not take place for nozzles that would normally require restorative operation, and nozzles may not be restored by predetermined restorative operation. Also, ink is unnecessarily consumed when restorative operation is performed for nozzles that would normally not require restorative operation.

In the image recording method, apparatus, recorded matter thereof, and manufactured products thereof disclosed in Japanese Patent Application Publication No. 5-301427, a shuttle head that performs printing as it scans in the main scanning direction is used as the recording head, and if a line head is involved, there is no subsequent scanning in the main scanning direction, so corrections cannot be made to the defective recording positions.

Also, in the inkjet recording apparatus disclosed in Japanese Patent Application Publication No. 6-143548, the light receiving elements and the recording elements have the same resolution, and when large droplets are ejected from all the nozzles, the dots formed by droplets ejected from neighboring nozzles overlap, making it difficult to read one dot at a time. Furthermore, no disclosure is made with regard to the case in which two or more colors are used, and no distinction can be made for two or more colors.

SUMMARY OF THE INVENTION

The present invention has been implemented in view of such circumstances, and an object thereof is to provide an inkjet recording apparatus and a discharge defect determination method that can quickly determine ink non-discharge and other defective discharges from the nozzle, and in which it is possible to make corrections to nozzles with a discharge defect.

In order to achieve the above-described object, the present invention is directed to an inkjet recording apparatus, comprising: a plurality of full-line recording heads provided for a plurality of ink colors, each of the plurality of full-line recording heads having one or more rows of nozzles in which a plurality of nozzles for discharging ink are arrayed across an entire width of a printing medium in a direction substantially orthogonal to a conveyance direction of the printing medium; and a plurality of image-reading devices provided for the plurality of ink colors, the plurality of image-reading devices reading an image formed on the printing medium with ink ejected from the plurality of recording heads provided for the colors, the plurality of image-reading devices being arranged on a downstream side in the conveyance direction of the printing medium with respect to the recording heads of the respective corresponding colors.

In accordance with the present invention, the recording heads for the colors of inks are provided with image-reading devices for reading images formed by ink droplets discharged from the corresponding recording heads on the respective downstream sides in the conveyance direction of the printing medium, making it possible to read the images on the image-forming medium for each color by the image-reading devices immediately after printing.

There is also an aspect in which a recording head for each of the colors black (K), cyan (C), magenta (M), and yellow (Y) is provided as the recording head corresponding to each of the colors, and an aspect in which heads for recording light colored-inks in the four above-described colors are provided.

The image-reading device may have a configuration in which a plurality of light receiving element groups are arrayed along the main scanning direction. Also, the reading device may also have an aspect in which an illumination device is included for directing light to the image to be read.

Line sensors with photoelectric transducers aligned in one row, or area sensors with light receiving elements arranged in two dimensions in the form of a matrix are used as the image-reading devices. CCD solid-state image sensors, MOS-type image pickup elements, or other image pickup elements may be used as these sensors.

Also, other components that may be provided include an illumination device for directing light to the ink droplets discharged from each of the nozzles onto the printing medium, and an optical member that magnifies the ink droplets discharged from each of the nozzles onto the printing medium and corrects optical path differences.

In the present specification, the term "printing" expresses the concept of not only the formation of characters, but also the formation of images with a broad meaning that includes characters.

A full-line recording head is normally disposed along the direction orthogonal to the conveyance direction (sub-scanning direction) of the printing medium, but also possible is an aspect in which the recording head is disposed along the diagonal direction at a predetermined angle with respect to the direction orthogonal to the conveyance direction.

The printing medium is a medium that is printed on by a recording head (medium on which an image is formed). The medium includes continuous paper, cut paper, seal paper, OHP sheets, and other resin sheets, as well as film, cloth, and various other media without regard to materials or shapes.

The conveyance device includes an aspect in which the printing medium is conveyed with respect to a stationary (fixed) recording head, an aspect in which the recording head is moved with respect to a stationary printing medium, or an aspect in which both the recording head and the printing medium are moved.

Also, the term "image" includes pictures, characters, and the like that are expressed with a single dot (point), or a plurality of dots.

In accordance with an aspect of the present invention, the plurality of recording heads includes two or more same-color recording heads that correspond to the shades of ink of the same color; and the image-reading devices used for reading images formed by the ejection of droplets from the same-color recording heads are shared.

In accordance with this aspect, some of the image-reading devices are shared, and the number of image-reading devices can be reduced.

In accordance with this aspect, the image-reading devices can be shared by the same-color recording heads, so the number of image-reading devices can be reduced and the control burden can be made lighter.

In an aspect provided with shades of ink, there are six ink colors or the like in which light cyan and light magenta, which are light colors of cyan and magenta, are used in addition to black, cyan, magenta, and yellow.

In accordance with another aspect of the present invention, the sensitivity of the shared image-reading devices that are used for reading images formed by the ejection of droplets from the same-color recording heads is set in accordance with the reading of the light-shaded ink.

Another aspect of the present invention entails further providing a determination device for determining discharge-defective nozzles from images read by the image-reading devices; and a discharge defect countermeasure device for carrying out processings, including at least one processing selected from an image correction and an action to restore the discharge-defective nozzles when such discharge-defective nozzles are determined by the determination device.

In accordance with this aspect, discharge-defective nozzles can be determined in the recording head from the image read by an image-reading device, and furthermore, the configuration is such that predetermined processings are carried out when a discharge-defective nozzle is determined, so discharge-defective nozzles can be determined immediately after printing, and a correction processing can be immediately carried out when discharge-defective nozzles are determined.

Discharge defects include non-discharge in which ink droplets are not discharged, discharge amount defects in which the amount of ink droplets discharged differs from the predetermined discharge amount, and flight direction abnormalities in which the flight direction of the ink droplets deviates from the predetermined direction. Also, these discharge defects can be determined from the size and position of the dots formed by the ink droplets.

In image correction, there is an aspect in which correction is carried out immediately after a discharge-defective nozzle is determined, and an aspect in which printing is stopped and corrected printing is carried out from the beginning of the printing.

The action to restore a discharge-defective nozzle includes suctioning action for suctioning off the ink intermixed with bubbles in the nozzle using a suctioning device, and a preparatory discharge for discharging the thickened ink in the nozzle into an ink receptor or the like. For the restorative operation, it is preferable to perform a restorative operation that is suitable to the stage of the discharge defect.

A preferred aspect is one in which a print device standby mechanism is provided for placing the print device on standby in order to perform the above-described restoring action (capping). The print head may be moved to the position of the cap or another restoration device, or the restoration device may be moved to the position of the print head.

In accordance with another aspect of the present invention, the determination device determines nozzles with discharge defects within each print head by way of an actual print job read by the image-reading devices, and the discharge defect countermeasure device performs control to cause other normal nozzles to make substitute ejections for the determined discharge-defective nozzles.

In accordance with this aspect, nozzle abnormalities are determined at an early stage during an actual print job, and an immediately recovery can be made by substitute ejections from other normal nozzles, so the printed matter being printed can be remedied. Also, a nozzle abnormality can be determined without performing a test print, and the printing medium is not wastefully consumed.

An actual print job includes a printout (printing) for obtaining desired printing results.

In substitute ejection, a dot that is bigger than a predetermined size may be formed by ejected droplets, and an ink droplet from an adjacent nozzle may be discharged diagonally. Substitute ejection is preferably performed with an adjacent nozzle of the same color.

Also, in accordance with another aspect of the present invention, the inkjet recording apparatus has a test print control device that controls the printing of a test image in a blank area of the printing medium; the determination device determines discharge-defective nozzles on the basis of the results of reading the test image with the image-reading devices; and the discharge defect countermeasure device controls to cause other normal nozzles to make substitute ejections for the determined discharge-defective nozzles.

Test printing is carried out in a blank area, the test print is read by an image-reading device, and the determination device is configured so as to determine nozzle discharge defects from these read results, so printing subsequent to the test printing can be remedied at a relatively early stage.

The blank area indicates an area between an actual print job area and the next actual print job area.

Printing a test image entails printing a test dot, a test pattern, or another test image, and is performed to determine whether the dot position, size, color, and the like are correctly printed. A special test image different from an actual print job is commonly printed.

A test image is preferably densely printed in each color.

Moreover, according to another aspect of the present invention, when producing dots of a size of n times a minimum dot interval in a direction substantially orthogonal to the printing medium conveyance direction, where n is an integer larger than one, the test print control device performs control for ejecting droplets from every n-th nozzle in order to form one row of dots along the direction substantially orthogonal to the printing medium conveyance direction, and performs control for printing a test image in which n rows of dots with a row pitch of n times the minimum dot interval in the printing medium conveyance direction are formed while changing droplet-ejecting nozzles.

In accordance with this aspect, dots are formed by the ejection of a droplet from every n-th nozzle in a row of dots in a direction substantially orthogonal to the printing medium conveyance direction, and n rows of dots are thereby formed, where n is an integer larger than 1. Thus, the droplets can be ejected from all the nozzles so that adjacent dots do not overlap each other, and read errors can be prevented.

In accordance with another aspect of the present invention, the image-reading devices have a row of sensors arrayed across the entire width of the printing medium in a direction substantially orthogonal to the conveyance direction of the printing medium.

In accordance with this aspect, one line can be read in a direction substantially orthogonal to the conveyance direction of the printing medium in a single read cycle. In order to read an image one dot at a time, he resolution of the image-reading devices must be smaller than the resolution of a single line of printing in a direction substantially orthogonal to the conveyance direction of the printing medium.

Also, in accordance with another aspect of the present invention, the image-reading devices have a row of sensors whose width is less than the entire width of the printing medium in a direction substantially orthogonal to the conveyance direction of the printing medium, and also a moving device for moving the image-reading devices across the entire width of the printing medium in a direction substantially orthogonal to the conveyance direction of the printing medium is provided.

In accordance with this aspect, the image-reading devices have a row of sensors whose width is less than the entire width of the printing medium in a direction substantially orthogonal to the conveyance direction of the printing medium, and also have a moving device for moving the image-reading devices in a direction substantially orthogonal to the conveyance direction of the printing medium, so even if the number of read pixels of the image-reading device is reduced, discharge defects can be determined for all nozzles through the use of the moving device.

In order to achieve the above object, the present invention is also directed to a discharge defect determination method in an inkjet recording apparatus wherein full-line recording heads having one or more rows of nozzles in which a plurality of nozzles for discharging ink are arrayed across an entire width of a printing medium in a direction substantially orthogonal to a conveyance direction of the printing medium are provided for each color in accordance with a plurality of ink colors, comprising: an image formation step of forming an image on the printing medium with ink droplets discharged from the nozzles; an image reading step of reading the image formed on the printing medium in the image formation step separately for each color by image-reading devices arranged on the downstream side in the conveyance direction of the printing medium with respect to the recording head of the respective corresponding colors; and a determination step of determining discharge-defective nozzles from the image read in the image reading step.

A preferable aspect is one provided with a discharge defect countermeasure step of performing an image correction processing or a nozzle restorative operation processing when a discharge-defective nozzle is determined.

Also, the inkjet recording device related to the present invention for achieving the above object has a plurality of full-line recording heads provided for a plurality of ink colors, each of the plurality of full-line recording heads having one or more rows of nozzles in which a plurality of nozzles for discharging ink are arrayed across an entire width of a printing medium in a direction substantially orthogonal to a conveyance direction of the printing medium; a test image printing medium which is arranged facing a surface of the nozzles of the recording heads and on which a test image from the recording heads is printed; an image-reading device which reads the test image formed on the test image printing medium; and a cleaning device which removes ink droplets that form the test image on the test image printing medium.

In accordance with the present invention, there is provided a test image printing medium for printing a test image, so a printing medium for test printing is not required.

Preferable is an aspect in which a printing medium cut to a standard size is used.

A transparent or semitransparent member may be used so that ink droplets (dots) ejected to the surface of the test image printing medium can be read by the reading device provided to the reverse surface side.

An aspect is possible whereby an optical member is provided between the test image printing medium and the image-reading device, and a read auxiliary function is added for magnifying or otherwise manipulating ink droplets by the optical member.

Also, the printing surface of the test image printing medium may be disposed substantially parallel to the printing surface of the printing medium, or may be disposed at a certain angle to the printing surface of the printing medium.

A preferred aspect has a recovery device for recovering ink droplets or the like removed from the test image printing medium by the cleaning device.

The cleaning device may also have an aspect in which ink droplets are blown off with air, or an aspect in which a blade or another cleaning member is used.

In accordance with an aspect of the present invention, there is a standby device for moving the test image printing medium to a predetermined standby position.

In accordance with this aspect, the test image printing device is disposed in a position facing the recording heads during the test print, and can be moved to a predetermined standby position during an actual print job, resulting in a compact mechanism.

The standby device is composed of a conveyance mechanism that includes a support guide, carriage, and other components; a drive system that includes a motor for driving the conveyance mechanism, a belt, and other components; and a control system that includes a microcomputer for controlling the drive system, recording elements, and the like, as well as other components.

The present invention is also directed to an inkjet recording apparatus, comprising: a plurality of full-line recording heads provided for a plurality of ink colors, each of the plurality of full-line recording heads having one or more rows of nozzles in which a plurality of nozzles for discharging ink are arrayed across an entire width of a printing medium in a direction substantially orthogonal to a conveyance direction of the printing medium; a test image printing medium which is arranged facing a surface of the nozzles of the recording heads and on which a test image from the recording heads is printed; and a plurality of image-reading devices provided for the plurality of ink colors, the plurality of image-reading devices reading the test image formed on the test image printing medium with ink ejected from the plurality of recording heads provided for the colors, the plurality of image-reading devices being disposed with respect to the recording heads of the respective corresponding colors.

In accordance with this aspect, each recording head is provided with an image-reading device, so the image can be read for each color, and each color can be read immediately after printing.

Also, the present invention provides a method invention for achieving the above object. In other words, the present invention is directed to a discharge defect determination method in an inkjet recording apparatus having a plurality of full-line recording heads that are provided for a plurality of colors and have one or more rows of nozzles in which a plurality of nozzles for discharging ink are arrayed across an entire width of a printing medium in a direction substantially orthogonal to a conveyance direction of the printing medium, comprising: a test printing step of forming a test image on a test image printing medium arranged facing a surface of the nozzles of the recording heads using ink droplets discharged from the nozzles; a test image reading step of reading the test image formed on the test image printing medium in the test printing step by image-reading devices in which a plurality of light receiving elements are arrayed in the conveyance direction of the printing medium; a determination step of determining discharge-defective nozzles from the image read in the image reading step; and a cleaning step of removing ink droplets that form the test image on the test image printing medium.

A preferred aspect is one in which a step is provided for moving the test image printing medium to a predetermined standby position when test printing is complete.

In accordance with the present invention, an image-reading device is provided immediately on the downstream side in the conveyance direction of the printing medium with respect to the recording head for each color, and the print results produced by the recording heads can be read with the image-reading device. Therefore, the image can be read immediately for each color after printing.

Also, discharge-defective nozzles can be determined from the read results, and a predetermined countermeasure processing can be carried out when discharge-defective nozzles are determined. Countermeasure processings include image correction, restorative operation for discharge-defective nozzles, and other measures, the preferred correction measures are performed. Therefore, discharge-defective nozzles can be determined for each color, preferred correction measures can be carried out at an early stage, and defective images are immediately restored.

The read devices are shared in two or more recording heads. For example, the reading device can be shared in a recording head in which shades of ink. Also, the image reading device may have a configuration in which a plurality of groups of light receiving elements are arrayed in the main scanning direction.

Determination of discharge-defective nozzles may be performed with an actual print job, or with a test printout. When determination of discharge-defective nozzles performed with an actual print job printing medium is not wasted, and when determination of discharge-defective nozzles is performed with a test print, discharge-defective nozzles can be corrected from the printout immediately thereafter. A preferable aspect is one in which substitute ejections from adjacent nozzles of the same color are made as a corrective measure for the discharge-defective nozzles.

Also, in an inkjet recording apparatus with a full-line head, a test image printing medium is disposed in a position facing the color-separated recording heads, and ink droplets are ejected from each nozzle during test image printing, so the printing medium is not wasted.

The test image formed by the droplets ejected onto the test image printing medium is determined by the image reading device disposed in a position facing the recording heads with the test image printing medium disposed therebetween, and the test image is read between two actual print jobs, and discharge defects are determined, so that corrective measures can be carried out for the discharge-defective nozzles from the subsequent printouts that immediately follow the test print, and the remedy can be applied from the head portion of the printout. A preferable configuration is one in which the test image printing medium can be placed on standby.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
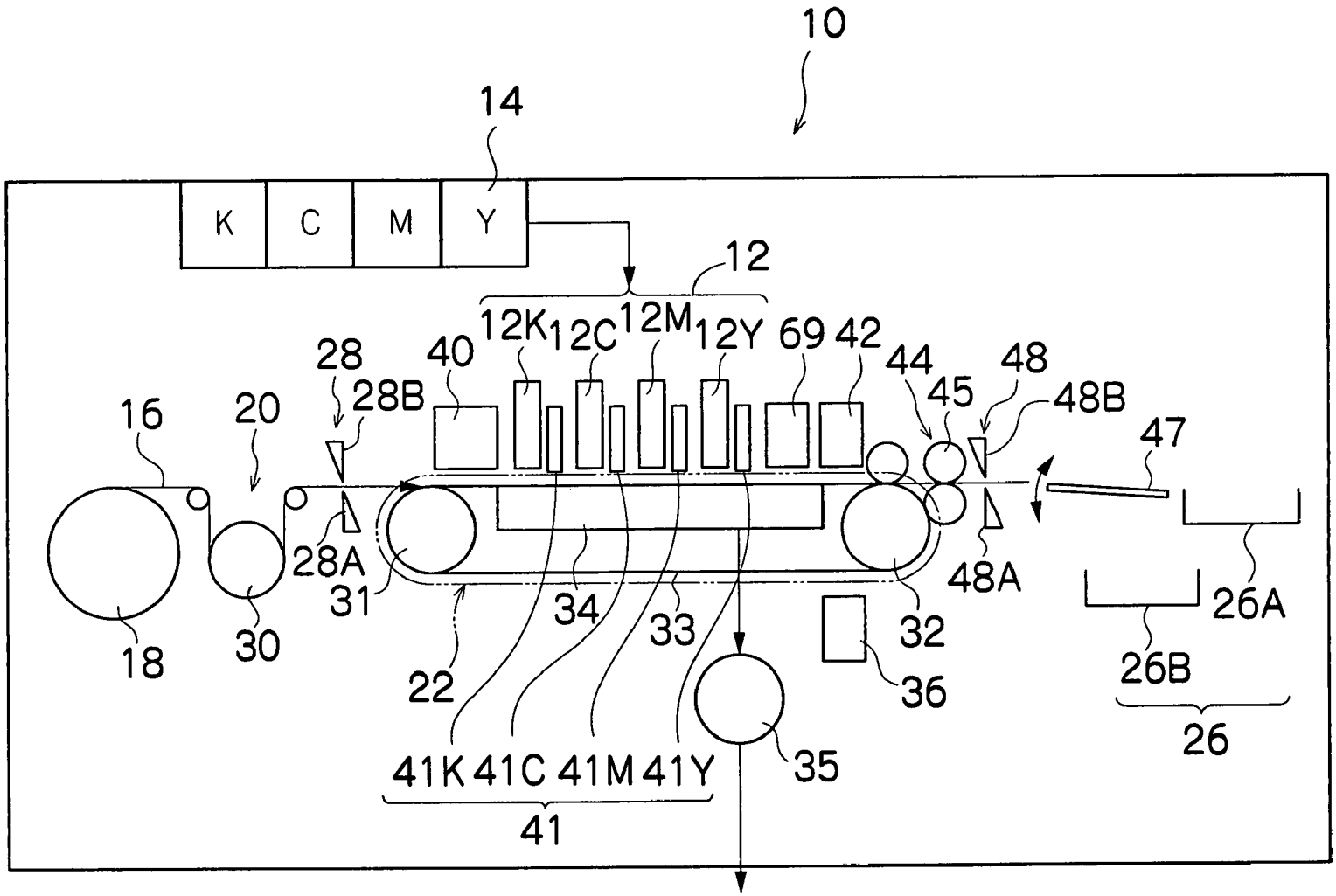
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 41 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 41 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 41 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
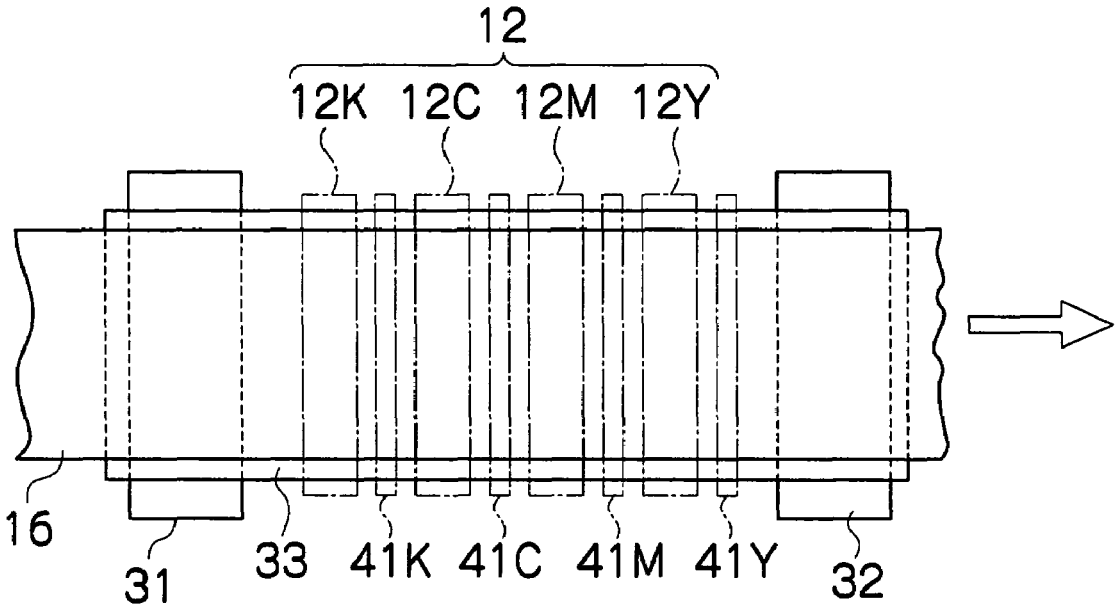
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 41 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 41 of the present example has a configuration that includes line sensors 41K, 41C, 41M, and 41Y provided for the print heads 12K, 12C, 12M, and 12Y, respectively. The line sensors 41K, 41 C, 41M, and 41Y are disposed at downstream sides of the print heads 12K, 12C, 12M, and 12Y, respectively, in the paper conveyance direction. A preferred aspect in one in which the line sensors are placed closer to the sensor side of the colors to be read than the intermediate position between the print heads.

Also, the line sensors (image sensors) 41K, 41C, 41M, and 41Y are configured with line sensors having a row of light receiving elements with a width that is greater than the ink discharge width (image recording width) of at least the print heads. Each of the line sensors 41K, 41C, 41M, and 41Y is configured with a color separation line CCD sensor including a red (R) sensor row composed of photoelectric transducing elements (pixels) arranged in a line provided with an R filter, a green (G) sensor row with a G filter, and a blue (B) sensor row with a B filter. The line sensors 41K, 41C, 41M, and 41Y may be sensors for black-and-white light. Instead of a line sensor, it is possible to use an area sensor composed of photoelectric transducing elements, which are arranged two-dimensionally.

The print determination unit 41 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. The details of the ejection determination are described later.

A post-drying unit 42 is disposed following the print determination unit 41. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is discharged from the paper discharge unit 26. The paper discharge path is switched by a conveyance switch 47 to separate the actual image (the result of printing the target image, an actual print job) that is originally to be printed and the test print. The actual print job is conveyed to the collection tray 26A, and the test print is sent to the waste tray 26B.

When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

The inkjet recording apparatus 10 is provided with a maintenance unit (restoration unit) 69, which performs restoring action onto the print heads 12K, 12C, 12M, and 12Y. Although the maintenance unit 69 is shown at a downstream side of the print heads 12K, 12C, 12M, and 12Y in FIG. 1, the maintenance unit 69 can be moved between a maintenance position directly below the ink-droplet ejection faces of the print heads 12K, 12C, 12M, and 12Y, and a holding position.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
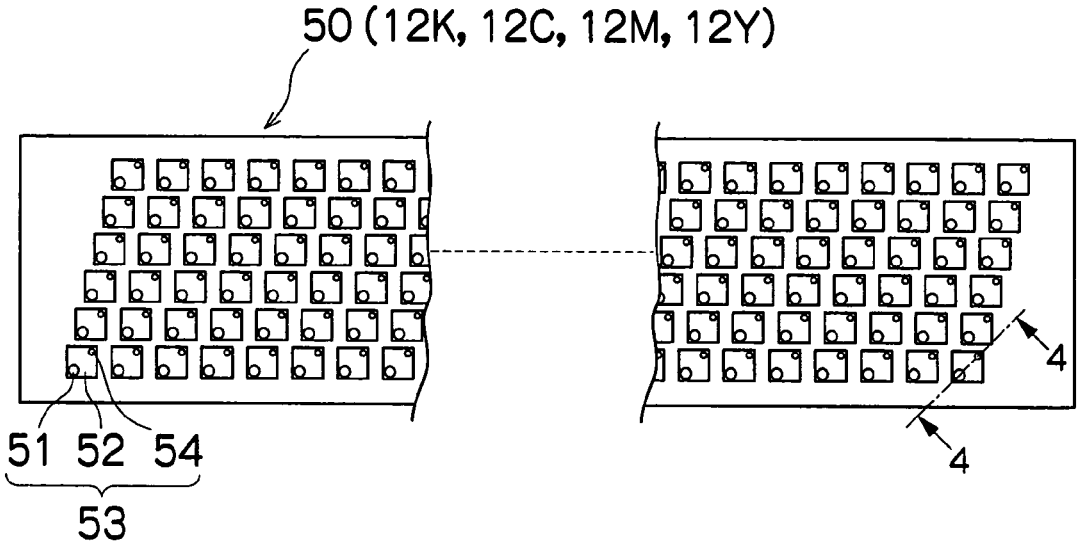
FIG. 3A is a perspective plan view showing an example of a configuration of a print head.
Figure 3B:
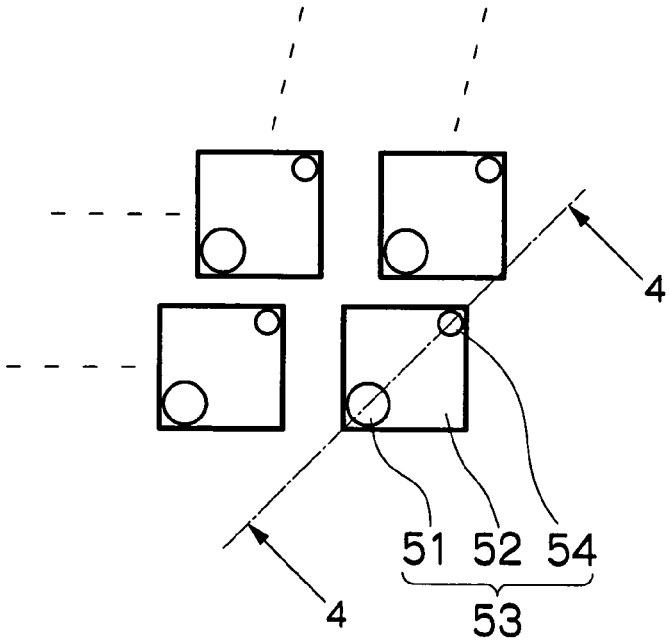
FIG. 3B is a partial enlarged view of FIG. 3A.
Figure 4:
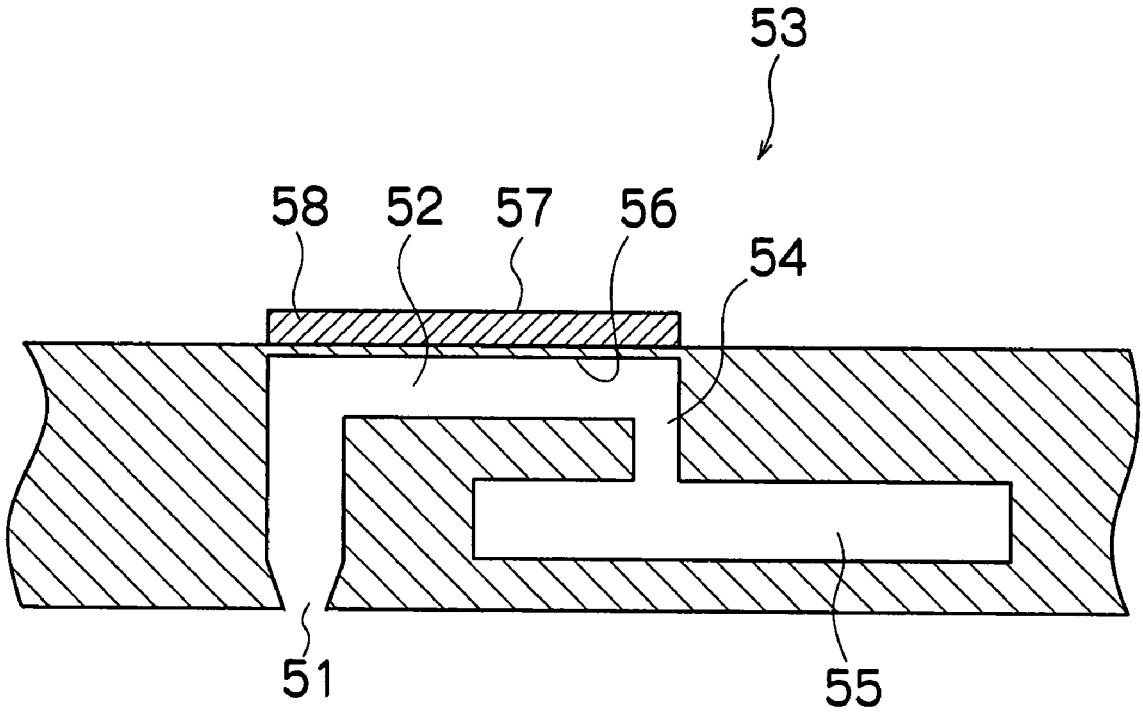
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, and FIG. 4 is a cross-sectional view taken along the line 4-4 in FIGS. 3A and 3B, showing the inner structure of an ink chamber unit. The nozzle pitch in the print head 50 should be minimized in order to maximize the density of the dots printed on the surface of the recording paper. As shown in FIGS. 3A, 3B and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

The planar shape of the pressure chamber 52 provided for each nozzle 51 is substantially a square, and the nozzle 51 and supply port 54 are disposed in both corners on a diagonal line of the square. Each pressure chamber 52 is connected to a common channel 55 through a supply port 54.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
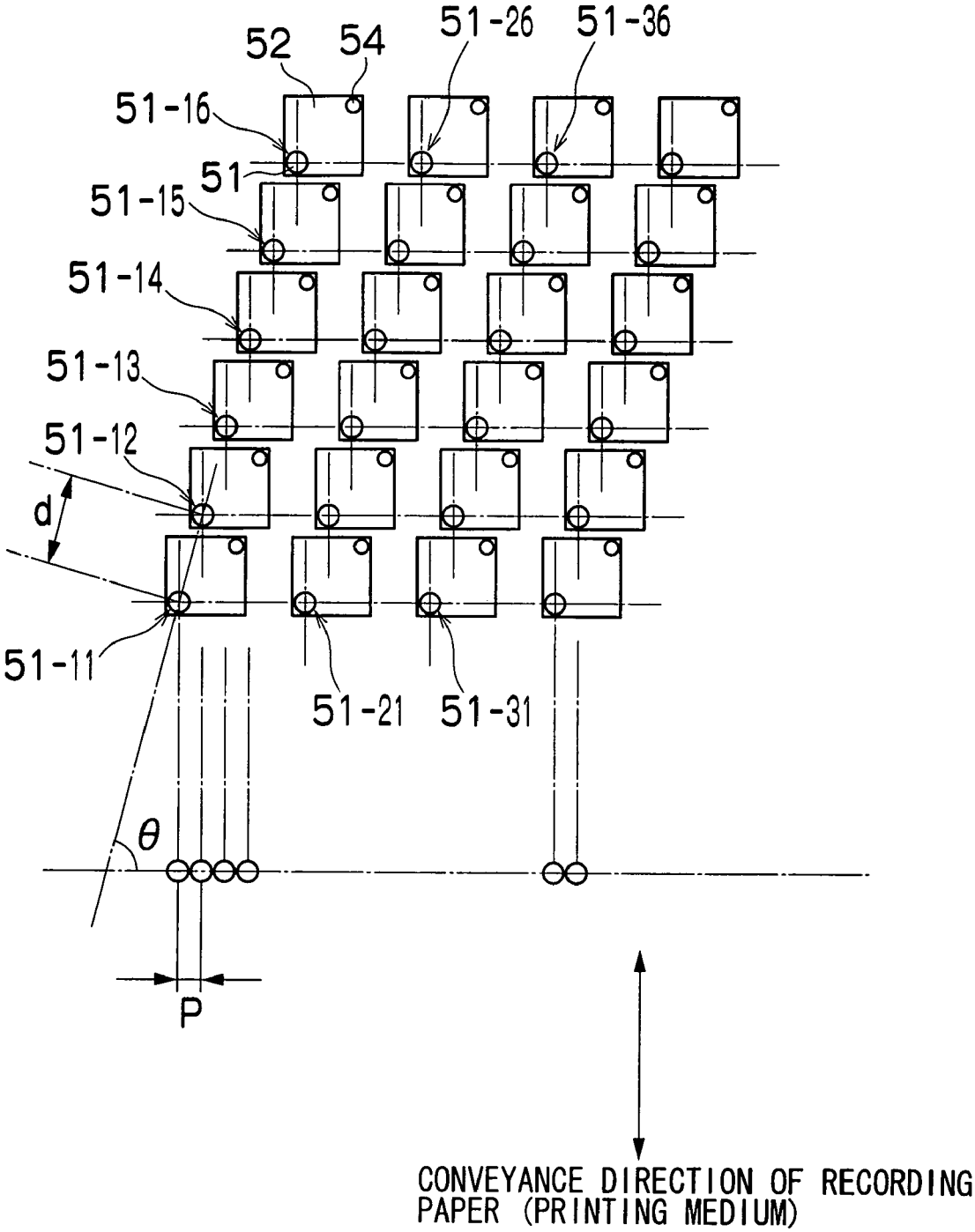
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Figure 6:
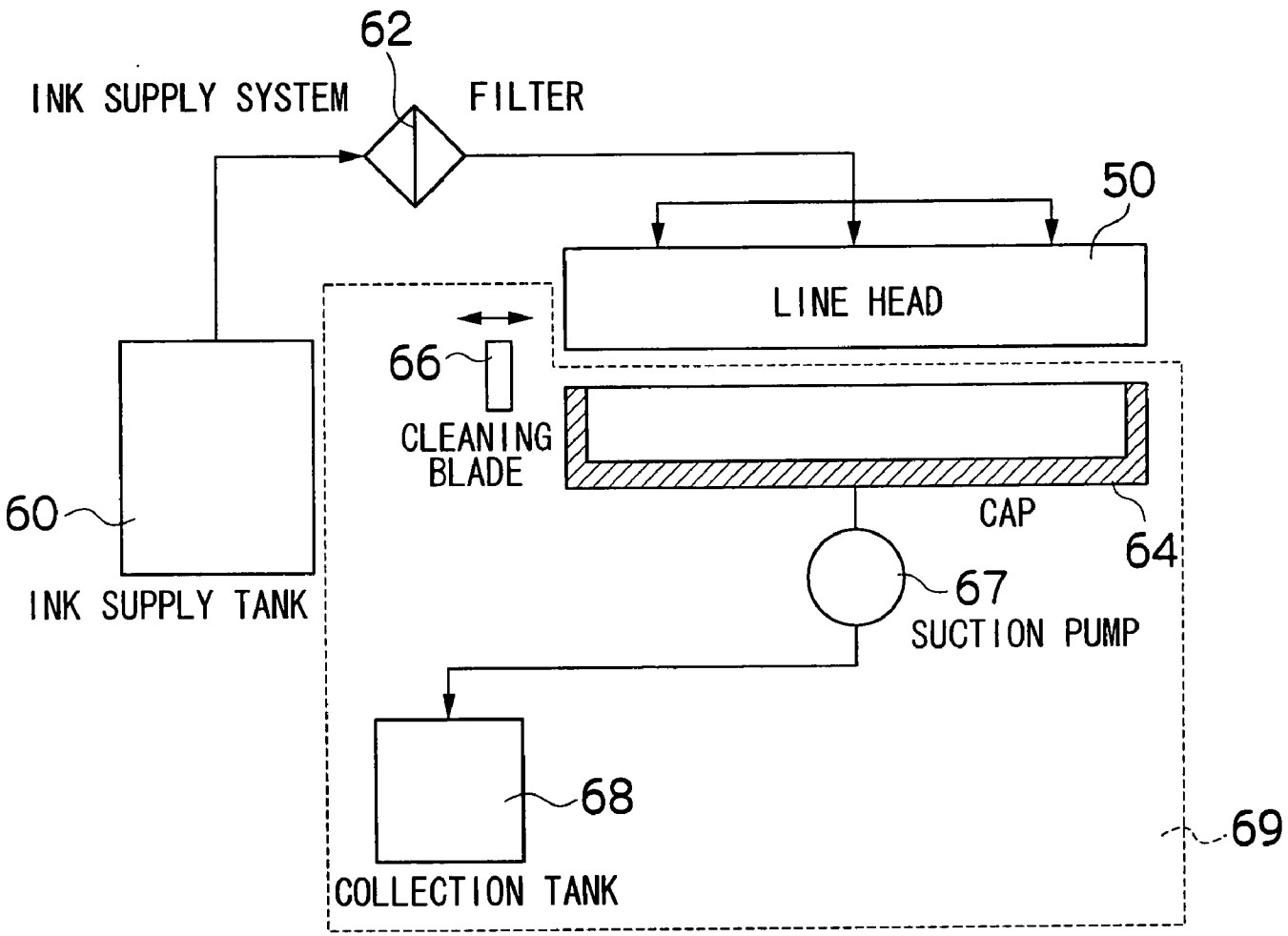
FIG. 6 is a schematic drawing showing a configuration of an ink supply system in the inkjet recording apparatus.

FIG. 6 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzle 51 from drying out or to prevent an increase in the ink viscosity in the vicinity of the nozzles, and a cleaning blade 66 as a device to clean the nozzle face.

The maintenance unit (restoration unit) 69 including the cap 64 and the cleaning blade 66 can be moved in a relative fashion with respect to the print head 50 by a movement mechanism (not shown), and is moved from the predetermined holding position to the maintenance position below the print head 50 as required. In an alternative embodiment, the inkjet recording apparatus 10 is provided with a movement mechanism to move the print head 50, and the print head 50 is moved toward a stationary maintenance unit 69 when restored.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

During printing or standby, when the frequency of use of specific nozzles 51 is reduced and a state in which ink is not discharged continues for a certain amount of time or longer, the ink solvent in the vicinity of the nozzle evaporates and ink viscosity increases. In such a state, ink can no longer be discharged from the nozzle 51 even if the actuator 58 is operated.

Before reaching such a state the actuator 58 is operated (in a viscosity range that allows discharge by the operation of the actuator 58), and a preliminary discharge (purge, air discharge, liquid discharge) is made toward the cap 64 (ink receptor) to which the degraded ink (ink whose viscosity has increased in the vicinity of the nozzle) is to be discharged.

Also, when bubbles have become intermixed in the ink inside the print head 50 (inside the pressure chamber 52), ink can no longer be discharged from the nozzle even if the actuator 58 is operated. The cap 64 is placed on the print head 50 in such a case, ink (ink in which bubbles have become intermixed) inside the pressure chamber 52 is removed by suction with a suction pump 67, and the suction-removed ink is sent to a collection tank 68.

This suction action entails the suctioning of degraded ink whose viscosity has increased (hardened) when initially loaded into the head, or when service has started after a long period of being stopped. The suction action is performed with respect to all the ink in the pressure chamber 52, so the amount of ink consumption is considerable. Therefore, a preferred aspect is one in which a preliminary discharge is performed when the increase in the viscosity of the ink is small.

The cleaning blade 66 is composed of rubber or another elastic member, and can slide on the ink discharge surface (surface of the nozzle plate) of the print head 50 by means of a blade movement mechanism (wiper, not shown). When ink droplets or foreign matter has adhered to the nozzle plate, the surface of the nozzle plate is wiped, and the surface of the nozzle plate is cleaned by sliding the cleaning blade 66 on the nozzle plate. When the unwanted matter on the ink discharge surface is cleaned by the blade mechanism, a preliminary discharge is carried out in order to prevent the foreign matter from becoming mixed inside the nozzles 51 by the blade.

Figure 7:
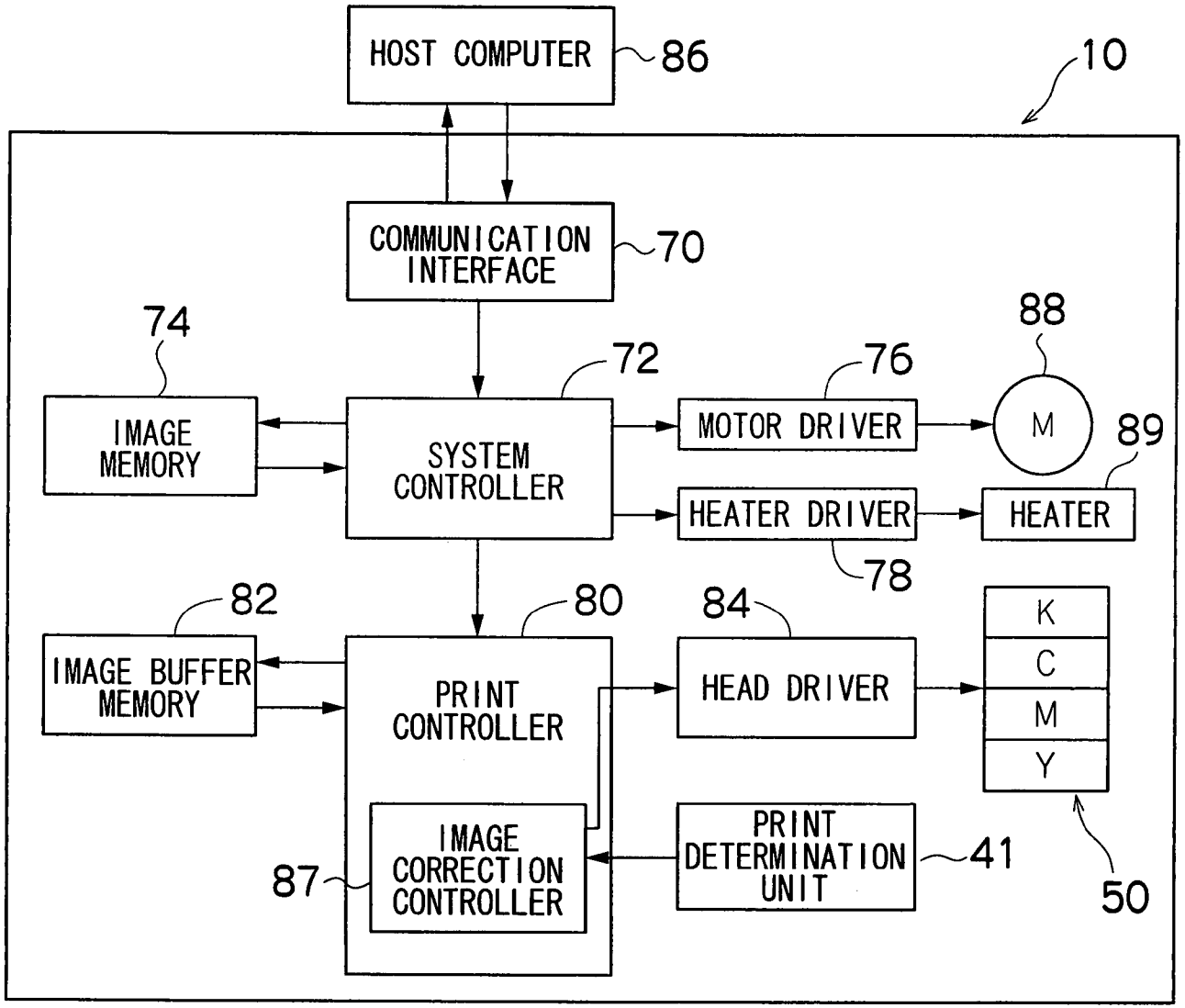
FIG. 7 is a block diagram of principal components showing a system configuration of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80.

A feedback control system for keeping the drive conditions for the print heads constant may be included in the head driver 84.

The print determination unit 41 is a block that includes the line sensors 41K, 41C, 41M and 41Y as described above with reference to FIG. 1, reads the image printed on the recording paper 16, determines the print conditions (presence of the ejection, variation in the dot deposition, and the like) by performing desired signal processing, or the like, and provides the determination results of the print conditions to an image correction controller 87 in the print controller 80.

The print controller 80 determines a discharge-defective nozzle according to the determination results obtained by the print determination unit 41, and the discharge-defective nozzle is subjected to an action to restore by means of the restoration unit 69. Thus, the print determination unit 41 operates as a determination device to determine discharge-defective nozzles.

On the other hand, the image correction controller 87 makes various compensation with respect to the print head 50 as required on the basis of the information obtained from the print determination unit 41, in order to prevent inferior image caused by the occurrence of the discharge-defective nozzle. The compensation includes image correction, and ejection correction by performing substitute ejection from a nozzle or nozzles other than the discharge-defective nozzle.

In the embodiment shown in FIG. 1, a configuration is adopted in which the print determination unit 41 is disposed on the printed surface side, the printed surface is illuminated by a cold-cathode tube or other light source (not shown) disposed in the vicinity of the line sensors 41K, 41C, 41M, and 41Y, and the light reflected on the printed surface is read with the line sensors 41K, 41C, 41M, and 41Y. However, as shown in FIG. 8, also possible in the implementation of the present invention is a configuration in which the line sensors 41K, 41C, 41M, and 41Y and light sources 92 are set facing each other across the conveyance pathway of the recording paper 16, the light sources 92 emit light from the reverse side of the recording paper 16 (opposite of the surface on which ink-droplets are deposited); and the amount of light transmitted through the recording paper 16 is read with the line sensors 41K, 41C, 41M, and 41Y The configuration with the transmission-type determination shown in FIG. 8 has an advantage in that the image blur acquired by the line sensor can be reduced in comparison with the configuration with the reflection-type determination.

However, in the case of the transmission-type configuration, the amount of light that enters the line sensor can be less than in the reflection-type configuration. Situations can be envisioned in which the amount of incident light is reduced in the reflection-type configuration as well. In either case, when the amount of light that enters the line sensor is small, an adequate determination signal cannot be obtained; however, since high resolution in the paper conveyance direction is not required when an image is read with the line sensor, the situation can be handled by lengthening the charge accumulation time of the line sensor, or by integrating the obtained data in the paper conveyance direction.

The read start timing for the line sensor is determined from the distance between the line sensor and the nozzles and the conveyance velocity of the recording paper 16.

Figure 8:
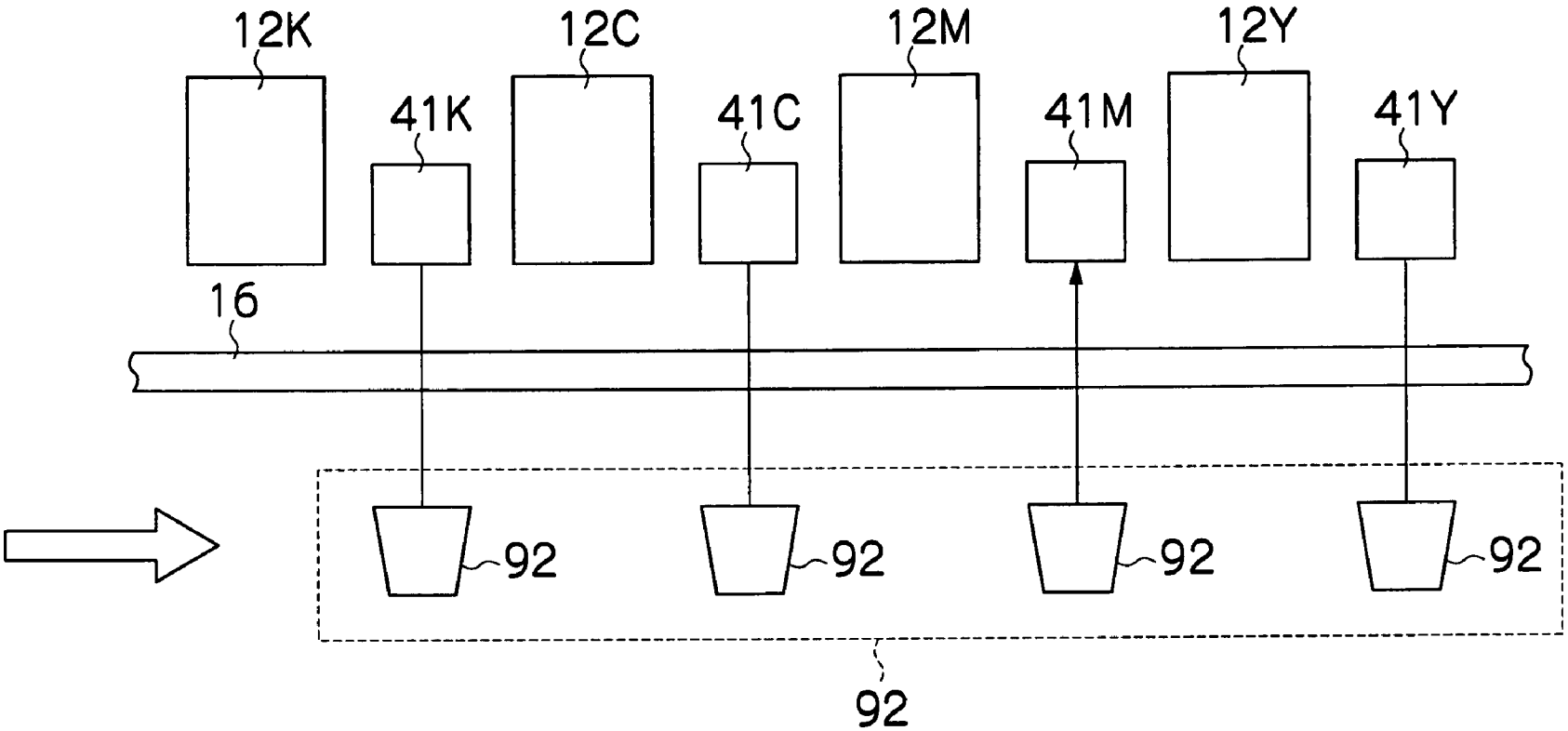
FIG. 8 is a drawing showing an example of another arrangement of a light source for illumination.

Although the plurality of light sources 92 are respectively provided for the line sensors 41K, 41C, 41M, and 41Y in the example shown in FIG. 8, it is also possible to provide a single light source that can move to each of the reading positions of the line sensors 41K, 41C, 41M, and 41Y, or a single light source that is large enough to illuminate all of the reading positions of the line sensors 41K, 41C, 41M, and 41Y.

Embodiment 1

Next, determination of discharge-defective nozzles and corrective measures thereof in the inkjet recording apparatus related to the first embodiment of the present invention is described.

In a full-line inkjet recording apparatus, when there is a nozzle with no discharge, abnormal discharge direction, abnormal discharge amount or another discharge defect, stripes and nonuniformity are generated in the print results in the paper conveyance direction because ink droplets are ejected from the same nozzles for one line in the paper conveyance direction. In order to inhibit the degradation of the print quality due to streaks, marks, or the like, discharge-defective nozzles must be quickly determined, and corrective measures carried out in accordance with the discharge defect.

First, the method for determining discharge-defective nozzles by means of a test print is described.

Figure 9:
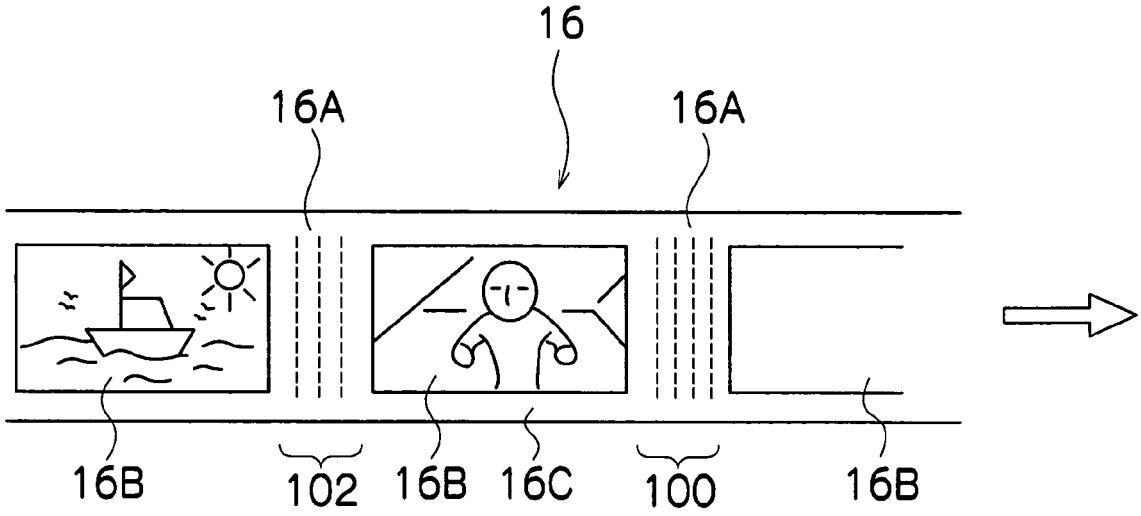
FIG. 9 is a drawing describing a test print of an inkjet recording apparatus related to the first embodiment of the present invention.

FIG. 9 shows an example in which test patterns 100 and 102 are printed in a test print area 16A of the recording paper 16 using rolled paper as the recording paper 16. The arrow in FIG. 9 shows the paper conveyance direction.

The test patterns 100 and 102 are formed by ejecting ink droplets from all the nozzles so that one line is formed along the main scanning direction for each color. The test patterns are formed by ejecting droplets for each color in order to provide the determination results as feedback to the discharge defect countermeasure device, and to prevent determination errors between colors.

Also, the size of the dots used in the test patterns 100 and 102 are a size that is equal to or less than the minimum dot interval. However, there is an aspect in which dots with a size larger than the minimum dot size are printed and divided into a plurality of rows as the ejecting nozzles are changed to print a test pattern. This is done with the aim of preventing dot determination errors, and each dot must be printed so as to not overlap with the neighboring dots.

Figure 16A:
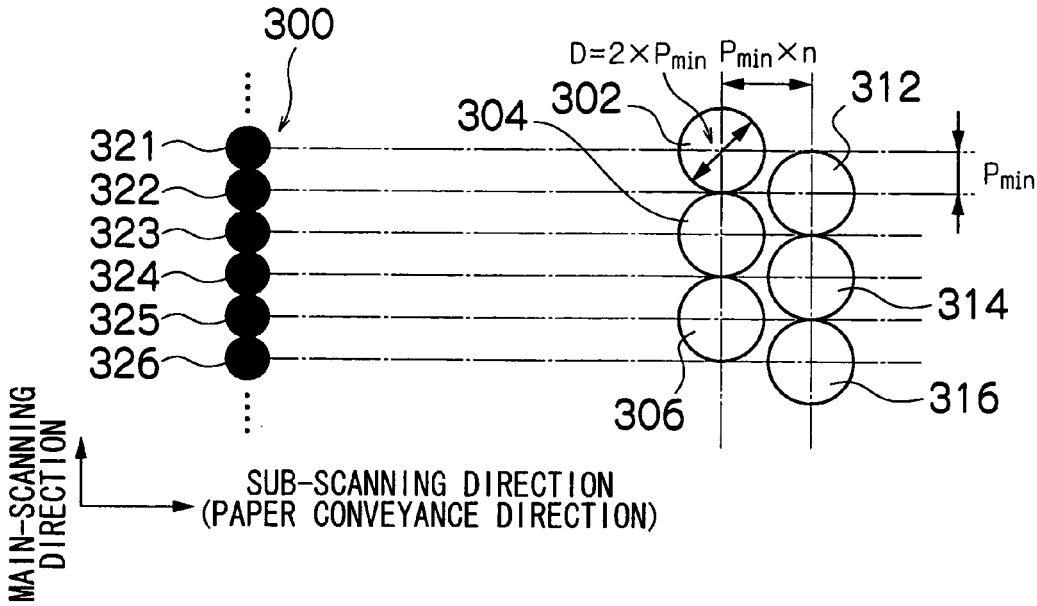
FIGS. 16A and 16B are drawings showing examples of test patterns.
Figure 16B:
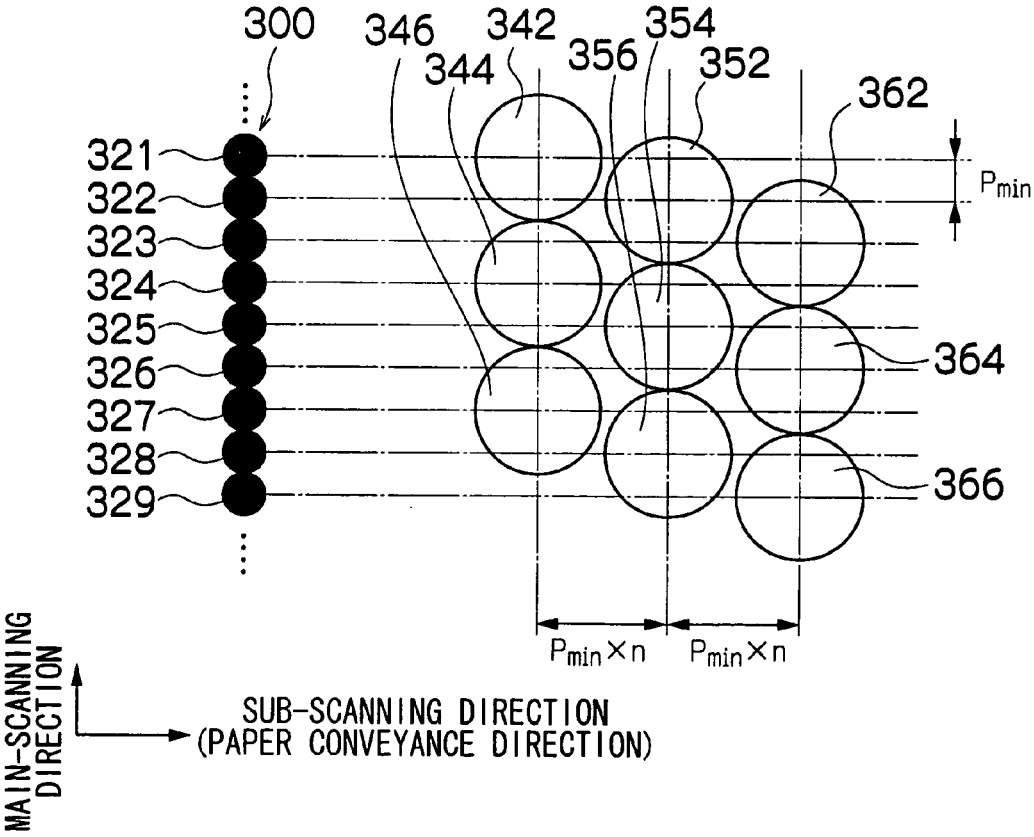

The minimum dot interval in the main scanning direction is herein the nozzle pitch (the distance between the centers of the nozzles) of a projected nozzle row 300, which is projected so as to align in the main scanning direction. In FIGS. 16A and 16B, Pmin is the minimum dot interval in the main scanning direction.

For example, when printing dots 302, 304, 306, . . . , 312, 314, 316, . . . of the size (the diameter D) that is twice the minimum dot interval Pmin as shown in FIG. 16A (i.e., when printing dots of the diameter D=2·Pmin), the dots 302, 304, 306, . . . , are formed along the main scanning direction by the ink-droplet ejection from the odd numbered nozzles (e.g., the nozzles 321, 323, 325, . . . ) within the neighboring nozzles (e.g., the nozzles 321, 322, . . . ) in the projected nozzle row 300, and the dots 312, 314, 316, . . . , are subsequently formed along the main scanning direction by the ink-droplet ejection from the even numbered nozzles (e.g., the nozzles 322, 324, 326, . . . ) at the timing in which the recording paper 16 has been conveyed by twice the minimum dot interval Pmin in the sub-scanning direction. In other words, when ejecting ink droplets to form dot rows along the sub-scanning direction, every n-th (where n is an integer larger than one) (i.e., second here) nozzle ejects an ink droplet at the same time to form the n (i.e., two here) dot rows in the main scanning direction.

On the other hand, when printing dots 342, 344, 346, . . . , 352, 354, 356, . . . of the diameter that is thrice the minimum dot interval Pmin as shown in FIG. 16B, the dots 342, 344, 346, . . . , are formed by the ink-droplet ejection from every third nozzles 321, 324, 327, . . . , simultaneously (i.e., at the same ejection timing). Then, at the timing in which the recording paper 16 has been conveyed by thrice the minimum dot interval Pmin in the sub-scanning direction, the dots 352, 354, 356, . . . , are simultaneously formed by the ink-droplet ejection from the nozzles 322, 325, 328, . . . , which are respectively next to the nozzles used in the previous ejection. Thereafter, at the timing in which the recording paper 16 has been conveyed by thrice the minimum dot interval Pmin in the sub-scanning direction, the dots 362, 364, 366, . . . , are simultaneously formed by the ink-droplet ejection from the nozzles 323, 326, 329, . . . , which are respectively next to the nozzles used in the previous ejection.

That is, when forming dots of the diameter D that is n times the minimum dot interval Pmin, where n is an integer larger than one, every n-th nozzle ejects an ink droplet at the same time in the sub-scanning direction, and thereby n rows of dots along the main scanning direction are formed. Thus, the ink-droplets are ejected so as to arrange the dots in a staggered manner (i.e., diagonally), so that the dots even with a large diameter can be prevented from overlapping each other, and determination errors can be avoided.

Furthermore, expanding on the description above, when printing with a dot diameter that is n times the minimum dot interval, dots are formed in the main scanning direction by ejection from every n-th nozzle with respect to the neighboring nozzle when projected so as to align in the main scanning direction, and in the same manner as when n=2, determination errors can be prevented without mutual overlap even with a large dot diameter by forming dots in a staggered manner in the form of n lines in the sub-scanning direction.

The test pattern 100 is formed by ejecting ink droplets from the print heads for all four colors, and the test pattern 102 is formed by ejecting ink droplets from the print heads of three of the four colors. An aspect is shown in which the test pattern 102 is formed by ejecting ink droplets from the print heads of three colors, but the test pattern may also be formed with the print heads of two colors, or even one color. Selection of the one to three colors from the four colors may be arbitrarily controlled according to the frequency of use of the nozzle, or to other factors.

In other words, nozzles that are frequently used have low possibility that the ink viscosity in the vicinity of the nozzles will increase, and a low possibility that bubbles from the nozzles will become intermixed, so the likelihood of a discharge defect is lower, and ink consumption can be reduced for heads of colors that have a high frequency of use by dispensing with test (pattern) printing. Also, test (pattern) printing is preferably carried out solely with nozzles that are used only infrequently, rather than separately for the head of each color. In this case, discharge and non-discharge are determined with the line sensors 41K, 41C, 41M, and 41Y solely for the dots ejected from the rarely used nozzles for which a test print is to be performed.

When test printing only three of four colors as in test pattern 102, the amount of ink consumed can be reduced. When one or two colors are used in one test print, the amount of ink consumed can be further reduced.

The test print area 16A may be disposed on the forward side of the recording paper 16 conveyance direction of the actual print job area 16B, or may be disposed on the rearward side. Also, as shown in FIG. 9, one test print area may be disposed for one actual print job area 16B, or a plurality of test print areas may be disposed. The key symbol 16C indicates the blank area in the margin portion of the recording paper 16.

Figure 10:
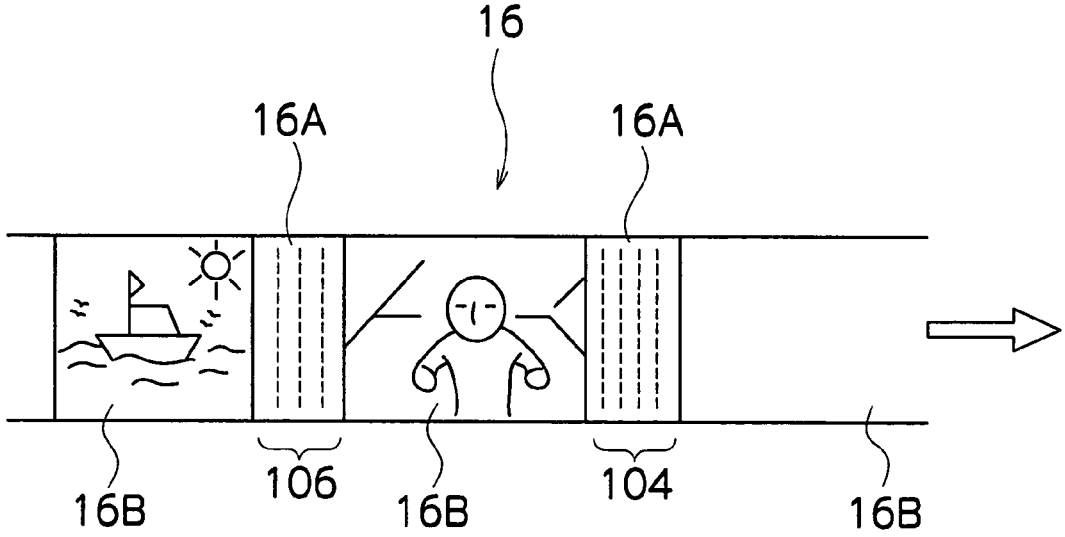
FIG. 10 is a drawing describing a test print in a printout with no margins of an inkjet recording apparatus related to the present embodiment.

Shown in FIG. 10 are test patterns 104 and 106 during printing with no margins. It is possible to print the test patterns 104 and 106 in the test printing area 16A in the same manner as FIG. 9 when printing without margins in which there is no blank area 16C in the margin portion shown in FIG. 9.

The test patterns 100, 102, 104, and 106 printed on the recording paper 16 in this manner are read for each color by the line sensors 41K, 41C, 41M, and 41Y provided to each print head.

An illumination device (not shown) is provided to each of the line sensors 41K, 41C, 41M, and 41Y, light is directed to the test pattern 100 by the illumination device, and the reflected light can be read by the light receiving elements in the line sensors 41K, 41C, 41M, and 41Y. The illumination device may be provided separately from the line sensors, but it is preferably disposed in the vicinity.

The read start timing is determined from the distance between the sensors and the nozzles, and from the conveyance speed of the recording paper 16.

The read resolution of the line sensors 41K, 41C, 41M, and 41Y is preferably sufficiently larger than the print resolution on the recording paper 16 in order to read the test pattern 100 one dot at a time with good accuracy. Furthermore, a preferable aspect is one in which the read resolution of the line sensors 41K, 41C, 41M, and 41Y is m times (where m is a positive integer) the print resolution.

If a shuttle scan-type for reading the test pattern 100 while a sensor with a width that is smaller than the possible printing width is moved with a moving device that scans (moves) in the width direction of the recording paper 16 is applied to the line sensors 41K, 41C, 41M, and 41Y, then the read resolution of the sensors can be compensated for by making the scanning resolution of the sensor more fine, even when the read resolution of the sensor is not sufficiently greater than the print resolution.

The scanning device is composed of a motor that is controlled by the controlling action of the system controller 72 or the like shown in FIG. 7, a conveyance device such as a ball screw or a conveyor belt that moves (shifts) a carriage to which sensors are attached, with the driving action of the motor, and a guide member or the like that directs the moving device.

At least the position of the dots and the size of the dots are read by the line sensors 41K, 41C, 41M, and 41Y in this manner, and this dot information is sent to the print controller 80 shown in FIG. 7. In the print controller 80, a comparison for all of the dots is made between the calculated dots that were originally to be ejected and the dots that were actually ejected, and the discharge-defective nozzles are determined based on the comparison results.

Discharge-defective nozzles have defects that include non-discharge in which ink droplets are not discharged, discharge amount defects in which the amount of ink droplets discharged differs from the predetermined discharge amount, and flight direction abnormalities in which the flight direction of the ink droplets deviates from the predetermined direction. Discharge defects other than these may also be determined.

When discharge-defective nozzles are determined, corrective processings are preferably carried out in accordance with the mode and degree of the discharge defect.

Corrective processings include image correction whereby images are corrected in the next printing, and nozzle restorative operation whereby the next printing is halted, and restorative operation is performed on the discharge-defective (non-discharge) nozzle.

There is also an aspect in which a substitute ejection from another normal nozzle is made for image correction. Substitute ejection includes an aspect in which a dot that is bigger than a predetermined size may be formed by ejected droplets from a neighboring nozzle, and an aspect in which the discharge direction of a neighboring nozzle is changed. A preferred aspect is one in which restorative operation is performed on the nozzle at a suitable time.

Also, the restorative operation includes liquid ejection to discharge ink clogged inside the nozzle 51 to the cap 64, wiping whereby the nozzle surface is cleaned by a wiping action, and ink suction that suctions clogged ink with a suction pump 67. When a predetermined restorative operation is completed, the next printing action is possible.

When a discharge-defective nozzle is determined, there is a possibility that streaks, marks, or other defects may occur in the actual print job just prior to test printing. Therefore, a preferred configuration is one in which the actual print job just prior to test printing is reprinted. An actual printjob in which reprinting is used is not limited to printing just prior to test printing, but reprinting may be used up to an arbitrary actual print job after the previous test print.

Figure 11:
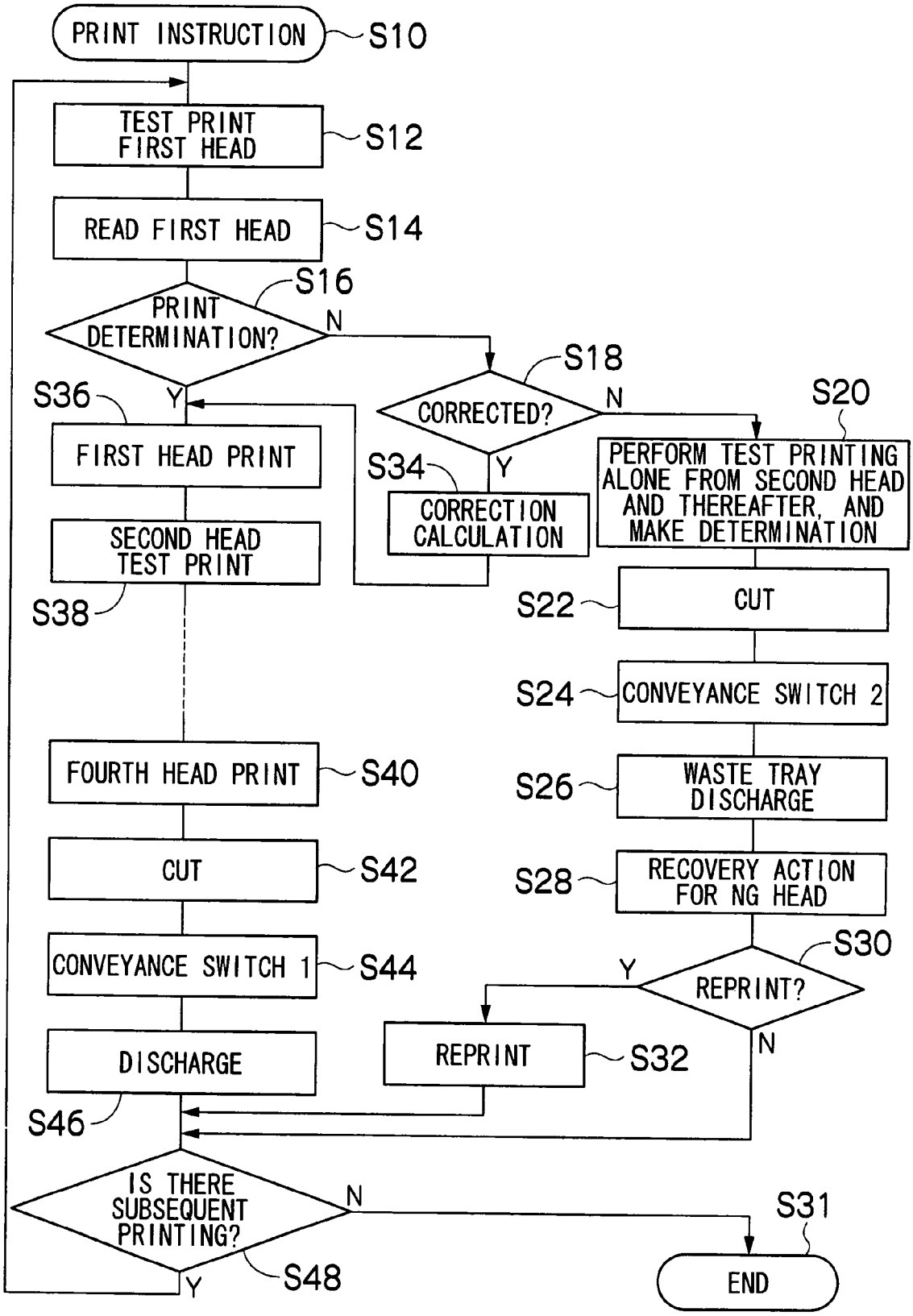
FIG. 11 is a flowchart showing the control flow of discharge-defective nozzle determination in an inkjet recording apparatus related to the present embodiment.

FIG. 11 is a flowchart showing the control flow of discharge-defective nozzle determination in the inkjet recording apparatus 10.

When a print instruction is sent from the system controller 72 to the print controller 80 (step S10), a black-colored test pattern is printed from the first head (print head 12K) to the test print area 16A of the recording paper 16 (step S12). The black-colored test pattern is read by the line sensors 41K (step S14), and a determination (print determination) of the read results is performed (step S16). In step S16, when it has been determined that there is a discharge defect in the first head (a NO decision), then it is determined whether dot correction is possible (step S18).

An example of the determination criterion as to whether dot correction is possible is determining that dot correction is possible if two or less nozzles have a discharge abnormality in the nozzle array projected so as to align in the main scanning direction. If there are three or more consecutive nozzles with an abnormal discharge, then it is very difficult to perform substitute ejection for the nozzles with an abnormal discharge by increasing the diameter of the dots that are formed by ejection from neighboring normal nozzles. If two or fewer nozzles have an abnormal discharge, then it is relatively simple to perform substitute ejection by increasing the diameter of the dots formed by neighboring normal nozzles.

In step S18, a determination is made as to whether the discharge-defective nozzle is a non-discharge nozzle, or whether the amount or direction of the nozzle discharge is abnormal. If it is determined (a NO decision) that dot corrective action is impossible (non-discharge nozzle), then a test print is performed solely with the second head (print head 12C), third head (print head 12M), and fourth head (print head 12Y), then the test pattern for each head is read, and it is determined that there is a discharge-defective head in each of the heads (step S20).

When step S20 is completed, the recording paper 16 is sent in the paper conveyance direction, the test print area 16A is cut by the cutter 48 (step S22), the conveyance direction is switched to the waste tray 26B side by the conveyance switch 47 (step S24), and the cut test print area 16A is stored in the waste tray 26B (step S28).

The above-described restorative operation is performed (step S28) on the nozzles determined to be discharge-defective nozzles for the nozzles inside each head, and the process advances to step S30.

In step S30, a determination is made as to whether or not to reprint, and if it is determined that reprinting is not be performed (a NO decision), then the process advances to step S48 and a determination is made as to whether there is subsequent printing.

Also, when reprinting is to be performed in step S30 (a YES decision), then reprinting is carried out (step S32) and the process advances to step S48.

In step S48, if it is determined that there is no subsequent data (a NO decision), then the print job is completed (step S31), and if subsequent print data is being transmitted (a YES decision), then the process advances to step S12 and the next printing action is carried out.

On the other hand, in step S18, if it is determined that corrective action is possible, then corrective calculations are performed in the print controller 80 (step S34), and black printing is performed by the first head (step S36).

Also, in step S16, if it is determined that there is no nozzle in the first head that is a discharge-defective nozzle (a YES decision), then black printing is performed by the first head (step S36).

Next, test printing for the second head is performed (step S38). Hereafter, the same control as the control in the first head is performed in the third and fourth heads.

Although omitted from the flowchart in FIG. 11, when it is determined that correction with a second test print in step S38 is impossible, then the process proceeds to perform and determine test printing for the third head and later in a manner corresponding to step S20.

When cyan printing is performed with the fourth head (step S40), then the actual print job is completed; and the recording paper 16 is sent in the paper conveyance direction and cut to a predetermined size with the cutter 48 (step S42). At this time, the conveyance switch 47 is switched to the collection tray 26A side (step S44), and the actual print job is discharged to the collection tray 26A (step S46).

The process is configured so as to carry out the steps following reprinting after the restorative operations for the nozzles have been carried out, but also possible is a configuration whereby when the restorative operations for the nozzles are carried out, actual printing is performed without performing a test print.

In an aspect in which a piezoelectric element is used as the actuator 58 shown in FIG. 4, the size of the dots can be changed in a stepwise fashion with the discharge amount of the ink droplets. If small droplets can be discharged, the large ones may also be discharged, so small droplets alone need be determined. However, in this case, the line sensors must have high resolution (high density).

On the other hand, when a determination is made with large droplets, the test pattern must be configured so the that the dots do not overlap, but in this case the line sensors are not required to have high resolution.

In the present embodiment, the line sensors 41K, 41C, 41M, and 41Y, which are the reading devices, are provided to each print head corresponding to each color, but two or more colors may be read with shared line sensors. In this case, it is possible to stop printing, reprint, and perform restorative operations for nozzles when the interval between the print heads and the line sensors 41K, 41C, 41M, and 41Y is less than the distance between the images, but dot (image) correction is not possible.

In the present embodiment, an aspect is shown in which test printing is performed to determine discharge-defective nozzles, but also possible is an aspect in which an actual print job is read, and discharge-defective nozzles are determined.

When an actual print job is read, line sensors with a plurality of colors (RGB) are used as the read sensors of the print determination unit 41. Black (K) is determined using the average output value of all the RGB sensors, and cyan (C) is determined using the output of the R sensor in an area in which K has not been ejected. Furthermore, magenta (M) is determined using the output of the G sensor in an area in which K and C have not been ejected. Cyan (Y) is determined using the output of the B sensor in an area in which K, C, and M have not been ejected.

K ink gives substantially the same output variation as each of the RGB sensors. Therefore, an accurate determination is made possible by using the average value of these and performing this processing first. Also, color material normally has sub-absorption on the short wavelength side, so C ink is absorbed in the R area and is also absorbed at shorter wavelengths, that is, in the G and B areas. In other words, C ink affects the determination of M ink and Y ink. It is therefore preferable to perform processing in the order in which the colors have a wide range of effects (in other words, in order from longer wavelengths) in order to eliminate such effects. In this fashion, processing between colors can be efficiently carried out. The determination method for the above-described actual print job is no more than an example, and other determination methods may be used.

When discharge-defective nozzles are determined, the same corrective action is performed as in the case of reading the above-described test print.

In the inkjet recording apparatus 10 configured in the manner described above, the line sensors 41K, 41C, 41M, and 41Y are provided to the print head for each color on the downstream side in the paper conveyance direction, the test patterns printed for each color are read by the line sensors 41K, 41C, 41M, and 41Y provided to the print head for the colors, and discharge-defective nozzles are determined from the read result. Discharge-defective nozzles can be determined immediately, and it is possible to carry out modified instructions for printing with respect to subsequent printouts. Reading dots, determining discharge-defective nozzles, and controlling a series of corrective actions can be carried out for each color.

Embodiment 2

Next, the inkjet recording apparatus related to the second embodiment of the present invention is described.

Figure 12:
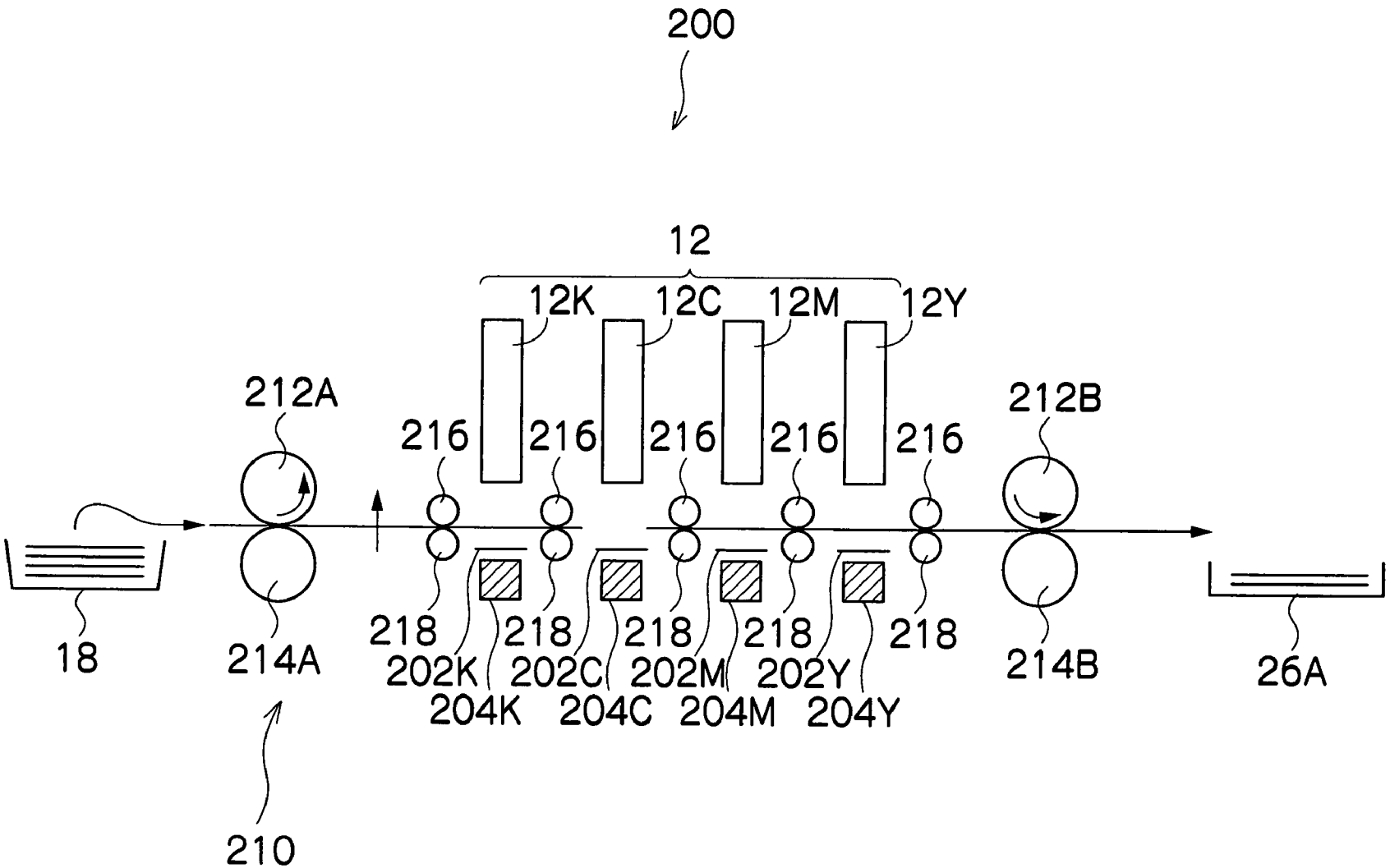
FIG. 12 is a schematic drawing of the principal components of an inkjet recording apparatus related to the second embodiment of the present invention.

FIG. 12 is a schematic drawing of the principal components of an inkjet recording apparatus 200 related to the second embodiment of the present invention. Shown in FIG. 12 are the principal components of the inkjet recording apparatus 200. The portions that are not shown are, in principle, the same as FIG. 1, the same key symbols in FIG. 12 are given to the portions that are the same as or similar to those in FIG. 1, and a description thereof is omitted.

The inkjet recording apparatus 200 has a printing unit 12 with print heads 12K, 12C, 12M, and 12Y provided for each ink color; test pattern printing media 202 (202K, 202C, 202M, and 202Y) which are disposed in a position facing the nozzle surface of each print head and to which ink droplets are ejected from each of the heads during test printing; a print determination unit 41 that includes image sensors 204 (204K, 204C, 204M, and 204Y) which read the ink droplets (dots) ejected to the test pattern printing media 202 and determine nozzle discharge defects from the read image; a conveyance unit 210 for conveying (left to right in FIG. 12) recording paper (cut paper) 16 loaded into a paper supply unit (paper supply tray) 18 to the downstream side of the paper conveyance direction; and a collection tray 26A for storing image-printed recorded matter (printed matter).

Although not shown in FIG. 12, a cleaning device (key symbol 220 in FIG. 13) for cleaning ink ejected to the test pattern printing media 202 is disposed adjacent to the test pattern printing media 202.

Cut paper is used as the recording paper 16, but rolled paper may also naturally be used. When rolled paper is used, a cutter is required for cutting rolled paper at a predetermined position. The details of the cutter are as described in FIG. 1.

Shown in FIG. 12 is a situation in which test printing is being performed with the print head 12C. In the inkjet recording apparatus 200, printing to the previous recording paper is completed for each print head, the recording paper is conveyed in the downstream direction, and test printing is performed until the next recording paper arrives under the head.

In other words, the actual print job is completed, test printing is carried out before the next actual print job is performed, the dots formed by droplet deposition on the test pattern printing media 202C by test printing are read by the image sensor 204C provided to the print determination unit 41, and discharge-defective nozzles are determined for nozzles inside the print head 12C. The same test printing is, of course, performed for the print heads 12K, 12M, and 12Y, and discharge-defective nozzles inside each of the print heads are determined.

Line sensors may be used as the image sensors 204, or area sensors may be used. Also possible is a configuration in which a plurality of sensors is aligned in the main scanning direction.

The conveyance unit 210 includes drive rollers 212 and 214 together with driven rollers 216 and 218. In the mechanism, the drive rollers 212 and 214 are turned by the driving force of the motor 88 shown in FIG. 7, and the recording paper 16 is sent to the downstream side in the paper conveyance direction by the drive rollers 212 and 214 while sandwiched therebetween.

The driven rollers 216 and 218 are positioned between the upstream drive rollers 212A and 214A, and the downstream drive rollers 212B and 214B, and are provided to assist in the conveyance of the recording paper 16 so that the recording paper 16 is not bent or that displacement of the conveyance direction does not occur. The recording paper 16 is conveyed by the driven rollers 216 and 218 while sandwiched therebetween in the same manner as the drive rollers 212 and 214.

Although not shown in FIG. 12, a guide or another support member is provided to the conveyance unit 210 in order to assure the planarity of the portion facing the printing unit 12 and print determination unit 41 of the recording paper 16.

In the present embodiment, a roller nip conveyance is used as a conveyance unit 210, but conveyance other than roller nip conveyance may also be used. However, the above-described planarity of the recording paper 16 must be assured. Also possible is an aspect in which both edges of the recording paper 16 are held while being conveyed, and it is further possible to use belt conveyance based on a conveyor belt provided with slits that allow ink droplets to pass through.

Figure 13:
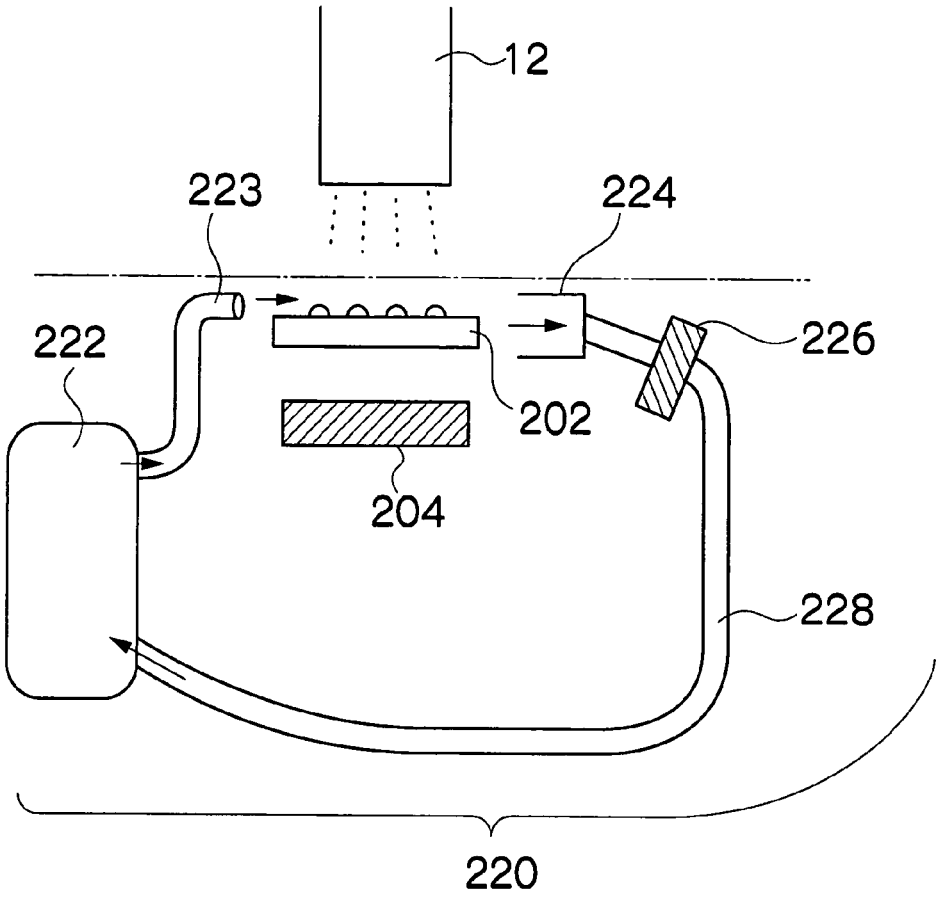
FIG. 13 is a schematic drawing of the print determination unit of an inkjet recording apparatus related to the present embodiment.

The details of the print determination unit 41 of the inkjet recording apparatus 200 are described with reference to FIG. 13. The print determination unit for each color has the same configuration.

The print determination unit 41 is composed of a test pattern printing media 202 to which ink droplets are ejected during test printing; an image sensor 204 for reading the dots formed by ink droplets ejected to the test pattern printing media 202; and a cleaning device 220 for removing ink droplets on the test pattern printing media 202.

The image sensor 204 has an illumination device (not shown) for directing light to the test pattern. The illumination device is provided to the print head side.

The cleaning device 220 is composed of an ink receptor 224 for collecting ink droplets on the test pattern printing media 202 that have been blown off by air delivered via the air nozzle 223 from a compressor 222, and a filter 226 and tube 228 provided to a mechanism that recovers air into the compressor 222. If there is no requirement that air be recovered into the compressor 222, then the filter 226 and tube 228 are not required.

Glass, resin, or another transparent member, or a semi-transparent member with adequate light transmittance can be used as the test pattern printing media 202 so that ink ejected to the reverse side thereof can be read with the image sensor 204. Also, ink droplets settle onto the test pattern printing media 202 when being read by the image sensor 204, and a material that easily removes the ink droplets during cleaning is preferably used for the cleaning device 220.

In the present embodiment, an aspect in which ink droplets are blown off from the surface of the test pattern printing media 202 by air is shown as the cleaning device 220, but also possible is an aspect in which the surface of the test pattern printing media 202 is wiped by a blade or the like.

Discharge-defective nozzles are determined and controlled in the present embodiment with the same control procedures and processings as in the above-described first embodiment. In other words, the same procedures are adopted to control the ink droplets of the test pattern, to control the reading of the test pattern, to establish the resolution of the image sensor 204, to determine discharge-defective nozzles, and to perform corrective actions as in the first embodiment, and a description thereof has been omitted.

Figure 14:
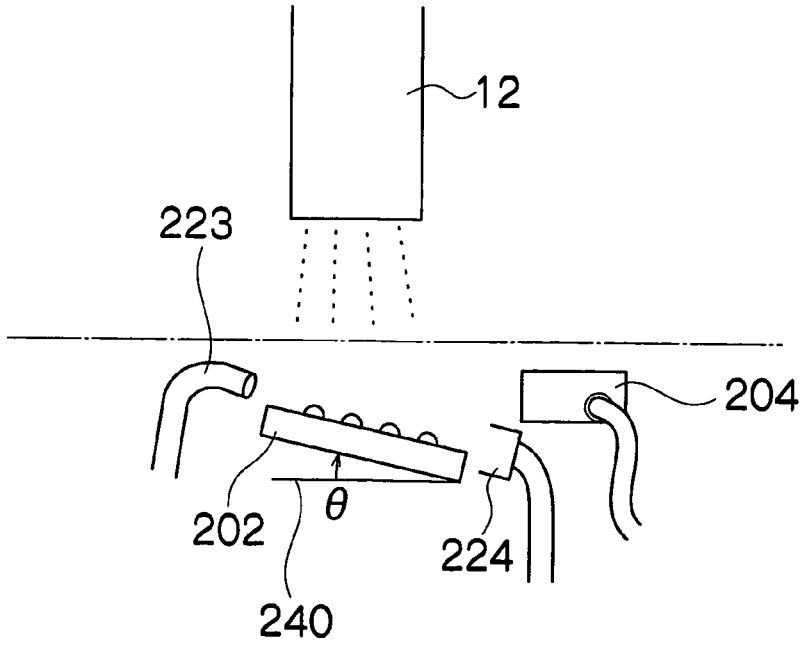
FIG. 14 is a drawing showing a modified example of the print determination unit of an inkjet recording apparatus related to the present embodiment.

FIG. 14 shows a modified example of the print determination unit 41 related to the second embodiment. In the present embodiment, an aspect is shown in which an image sensor 204, which is a read device, is placed facing the print head and is disposed on the reverse side (the opposite side of the print head) of the test pattern printing media 202, but the image sensor 204 may also be disposed on the downstream side (or the upstream side) in the paper conveyance direction of the test pattern printing media 202, or may be disposed at the lateral surfaced of the test pattern printing media 202 so as to be substantially orthogonal to the paper conveyance direction. Shown in FIG. 14 is an aspect in which the image sensor is disposed on the downstream side in the paper conveyance direction of the test pattern printing media 202.

In the present modified example, the test pattern printing media 202 is tilted at an amount equivalent to the angle θ from the surface 240 that is parallel to the printing plane of the recording paper 16, and ink droplets ejected onto the test pattern printing media 202 can be read by the image sensor 204 disposed on the downstream side in the paper conveyance direction.

Also, the angle θ must be set so that the ink droplets do not fall off from the surface of the test pattern printing media 202. The preferred range of angles θ is about 5° to 30°. Also, when the hydrophilicity of the ink is enhanced so that the ink does not fall off from the test pattern printing media 202, the ink droplets can no longer be removed from the test pattern printing media 202 during cleaning, so the contact angle of the ink droplets with the test pattern printing media 202 is preferably 30° to 150°. The contact angle indicates the degree of hydrophilicity of the ink droplets so that a large contact angle indicates slightly hydrophilic ink, and a small contact angle indicates highly hydrophilic ink.

Figure 15:
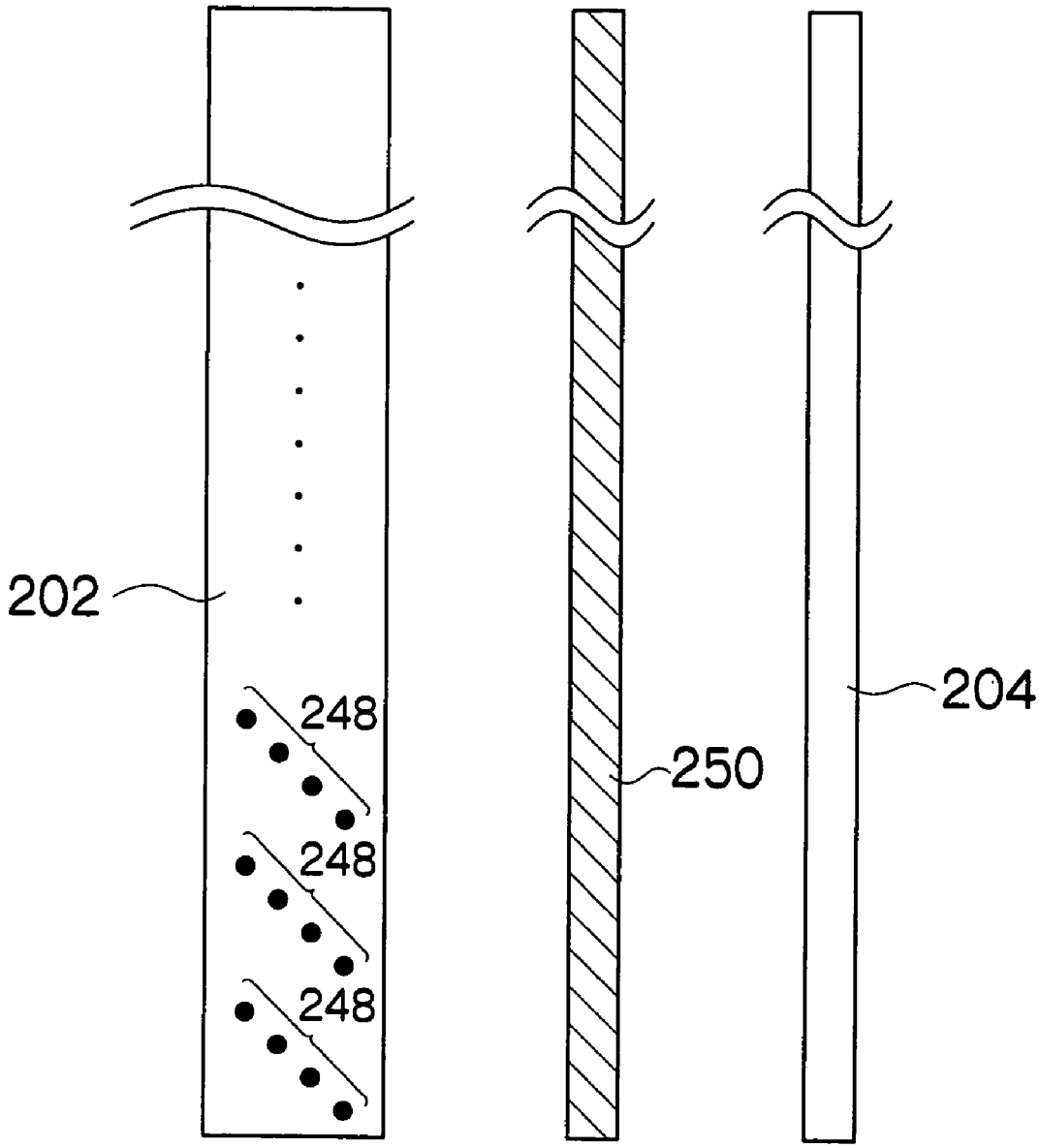
FIG. 15 is a drawing describing an aspect in which the print determination unit shown in FIG. 14 is provided with an optical correction device.

When the ink droplets that have landed on the surface of the test pattern printing media 202 in two dimensions are read using the image sensor 204, the distance between the ink droplets (dots) 248 and the image sensor 204 differs depending on the ejection position, as shown in FIG. 15, and focus cannot be achieved, so an optical correction device (correction plate) 250 must be provided between the test pattern printing media 202 and the image sensor 204.

FIG. 15 shows the appearance of the test pattern printing media 202, image sensor 204, and optical correction device 250 seen from the print head side.

A preferred aspect in one in which the test pattern printing media 202 is provided with a standby mechanism (not shown) so that it can move to a predetermined standby position when test printing is not taking place. The standby mechanism may be configured so that a support guide, carriage, or another mechanism is operated by a drive system composed of a motor, belt, and the like, and the drive system is controlled by means of a control system composed of a CPU, memory, and the like.

In the present embodiment, an aspect is exemplified in which the test pattern printing media 202 is provided to each of the print heads, but it is also possible to include these in an integral configuration.

In the inkjet recording apparatus 200 configured as described above, the print determination unit 41 is provided directly below the print head, test printing is carried out between actual print job images, and discharge-defective nozzles are determined. Recording paper 16 is not used for test printing, so recording paper 16 is not wastefully consumed.

In the first and second embodiments described above, the ink droplets ejected for determination purposes are not limited to one droplet, and a plurality of droplets may also be ejected in order to increase the read accuracy (in order to increase the S/N ratio). In the inkjet recording apparatus 10 shown in the first embodiment, in which paper conveyance cannot be stopped, the ejection results had an oval shape; and in the inkjet recording apparatus 200 shown in the second embodiment, in which the positions of the print heads and the reading devices (image sensors) 204 cannot be changed, the print results were in the form of single points as long as there is no overlap with the intervals of neighboring droplets.

A piezo-type inkjet recording apparatus in which ink discharge is controlled using a piezo element is exemplified in the present embodiment, but the present invention may be applied to a bubble inkjet recording apparatus.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a plurality of full-line recording heads provided for a plurality of ink colors, each of the plurality of full-line recording heads having one or more rows of nozzles in which a plurality of nozzles for discharging ink are arrayed across an entire width of a printing medium in a direction substantially orthogonal to a conveyance direction of the printing medium;

a plurality of image-reading devices provided for the plurality of ink colors, the plurality of image-reading devices reading an image formed on the printing medium with ink ejected from the plurality of recording heads provided for the colors, the plurality of image-reading devices being arranged on a downstream side in the conveyance direction of the printing medium with respect to the recording heads of the respective corresponding colors, a determination device which determines a discharge-defective nozzle from the image read by the image-reading devices;

a discharge defect countermeasure device which carries out processings, including at least one processing selected from an image correction and an action to restore the discharge-defective nozzle when the discharge-defective nozzle is determined by the determination device, wherein the determination device determines the discharge-defective nozzle within each print head by way of an actual print job read by the image-reading devices, and the discharge defect countermeasure device performs control to cause another normal nozzle from the same recording head as the discharge-defective nozzle, to make a substitute election for the determined discharge-defective nozzle.

2. The inkjet recording apparatus as defined in claim 1, wherein the plurality of recording heads include two or more same-color recording heads that correspond to shades of inks of the same color; and the image-reading devices used for reading the image formed by the ejection of droplets from the same-color recording heads are shared.

3. The inkjet recording apparatus as defined in claim 1, further comprising:

a test print control device that controls the printing of a test image in a blank area of the printing medium, wherein the determination device determines the discharge-defective nozzle on the basis of a result of reading the test image with the image-reading devices, and the discharge defect countermeasure device controls to cause another normal nozzle to make a substitute ejection for the determined discharge-defective nozzle.

4. The inkjet recording apparatus as defined in claim 1, wherein the image-reading devices have a row of sensors arrayed across the entire width of the printing medium in a direction substantially orthogonal to the conveyance direction of the printing medium.

5. The inkjet recording apparatus as defined in claim 1, wherein each of the image-reading devices has a row of sensors whose width is less than the entire width of the printing medium in a direction substantially orthogonal to the conveyance direction of the printing medium, and the inkjet recording apparatus further comprises a moving device which moves the image-reading devices across the entire width of the printing medium in the direction substantially orthogonal to the conveyance direction of the printing medium.

6. An inkjet recording apparatus, comprising:

a plurality of full-line recording heads provided for a plurality of ink colors, each of the plurality of full-line recording heads having one or more rows of nozzles in which a plurality of nozzles for discharging ink are arrayed across an entire width of a printing medium in a direction substantially orthogonal to a conveyance direction of the printing medium;

a plurality of image-reading devices provided for the plurality of ink colors, the plurality of image-reading devices reading an image formed on the printing medium with ink ejected from the plurality of recording heads provided for the colors, the plurality of image-reading devices being arranged on a downstream side in the conveyance direction of the printing medium with respect to the recording heads of the respective corresponding colors, wherein the plurality of recording heads include two or more same-color recording heads that correspond to shades of inks of the same color and the image-reading devices used for reading the image formed by the ejection of droplets from the same-color recording heads are shared, wherein sensitivity of the shared image-reading devices that are Listed for reading the image formed by the ejection of droplets from the same-color recording heads is set in accordance with the reading of lighter one of the inks of the same color.

7. An inkjet recording apparatus, comprising:

a plurality of full-line recording heads provided for a plurality of ink colors, each of the plurality of full-line recording heads having one or more rows of nozzles in which a plurality of nozzles for discharging ink are arrayed across an entire width of a printing medium in a direction substantially orthogonal to a conveyance direction of the printing medium;

a plurality of image-reading devices provided for the plurality of ink colors, the plurality of image-reading devices reading an image formed on the printing medium with ink ejected from the plurality of recording heads provided for the colors, the plurality of image-reading devices being arranged on a downstream side in the conveyance direction of the printing medium with respect to the recording heads of the respective corresponding colors, a determination device which determines a discharge-defective nozzle from the image read by the image-reading devices; and a discharge defect countermeasure device which carries out processings, including at least one processing selected from an image correction and an action to restore the discharge-defective nozzle when the discharge-defective nozzle is determined by the determination device, a test print control device that controls the printing of a test image in a blank area of the printing medium, wherein the determination device determines the discharge-defective nozzle on the basis of a result of reading the test image with the image-reading devices, and the discharge defect countermeasure device controls to cause another normal nozzle to make a substitute ejection for the determined discharge-defective nozzle, wherein when producing dots of a size of n times a minimum dot interval in a direction substantially orthogonal to the printing medium conveyance direction, where n is an integer larger than one, the test print control device performs control for ejecting droplets from every n-th nozzle in order to form one row of dots along the direction substantially orthogonal to the printing medium conveyance direction, and performs control for printing a test image in which n rows of dots with a row pitch of n times the minimum dot interval in the printing medium conveyance direction are formed while changing droplet-ejecting nozzles.

8. A discharge defect determination method in an inkjet recording apparatus wherein full-line recording heads having one or more rows of nozzles in which a plurality of nozzles for discharging ink are arrayed across an entire width of a printing medium in a direction substantially orthogonal to a conveyance direction of the printing medium are provided for each color in accordance with a plurality of ink colors, comprising:

an image formation step of forming an image on the printing medium with ink droplets discharged from the nozzles;

an image reading step of reading the image formed on the printing medium in the image formation step separately for each color by respective image-reading devices arranged on the downstream side in the conveyance direction of the printing medium with respect to the recording head of the respective corresponding colors;

a determination step of determining discharge defective nozzles from the image read in the image reading step;

an image correction step that corrects for a determined discharge-defective nozzle by causing a normal nozzle from the same recording head as the discharge-defective nozzle, to make a substitute ejection for the determined discharge-defective nozzle.

* * * * *